US005655397A

United States Patent [19]

Satoh et al.

[11] Patent Number: 5,655,397

[45] Date of Patent: Aug. 12, 1997

[54] METHOD FOR ROLLING A PLATE AND ROLLING MILL BOTH USING ROLL SHIFT AND ROLL BEND AND ROLL FOR USE THEREFOR

[75] Inventors: Kazuyuki Satoh; Hisashi Honjou; Masayoshi Satoh, all of Yokohama, Japan

[73] Assignee: Ishikawajima-Harima Heavy Industries Co., Ltd., Tokyo, Japan

[21] Appl. No.: 493,806

[22] Filed: Jun. 22, 1995

[30] Foreign Application Priority Data

| | | | |
|---|---|---|---|
| Jul. 8, 1994 | [JP] | Japan | 6-156315 |
| Jan. 13, 1995 | [JP] | Japan | 7-021326 |

[51] Int. Cl.[6] ..... B21B 31/07; B21B 31/32; B21B 13/14

[52] U.S. Cl. ..... 72/241.4; 72/247; 72/241.8

[58] Field of Search ..... 72/241.4, 241.8, 72/245, 247, 252.5, 366.2; 492/1, 3, 28

[56] References Cited

U.S. PATENT DOCUMENTS

| | | | |
|---|---|---|---|
| 4,881,396 | 11/1989 | Seidel et al. | 72/247 |
| 4,898,014 | 2/1990 | Ginzburg et al. | 72/247 |

FOREIGN PATENT DOCUMENTS

| | | | |
|---|---|---|---|
| 63-174709 | 7/1988 | Japan | 72/247 |
| 5-177218 | 7/1993 | Japan | 72/247 |
| 5-185107 | 7/1993 | Japan | 72/252.5 |
| 2198981 | 6/1988 | United Kingdom | 72/247 |

*Primary Examiner*—Lowell A. Larson
*Assistant Examiner*—Rodney A. Butler
*Attorney, Agent, or Firm*—Griffin, Butler, Whisenhunt & Kurtossy

[57] ABSTRACT

The rolling mill includes upper and lower work rolls, a roll bending apparatus for applying a bending force to the upper and lower work rolls, a roll shifter for axially shifting the upper and lower work rolls in opposite directions, and a back-up roll for supporting the upper and lower work rolls. The upper and lower work rolls have a bus having a contour comprising first to fifth regions. The rolling mill is adapted to have the large changability of plate crown effected by the roll shifting on plates with narrow or intermediate widths. The use of a combination of roll shifting and roll bending causes contours of the upper and lower work rolls to overlap deflection of the upper and lower work rolls, resulting in that a smooth roll diameter profile across the width of the plate to be rolled where the upper and lower work rolls contact the plate. Thus, it is possible to minimize the difference in a roll diameter, and to enhance the plate crown controllability, even for a plate having an intermediate or narrow width.

23 Claims, 19 Drawing Sheets

Concave Crown

Convex Crown

A : Roll Contour for Controlling Plate Crown

B : Heat Crown Compensation Contour

C : Increased Surface Pressure Compensation Contour

D : Roll Contour in Accordance with Invention

METHOD FOR ROLLING A PLATE AND ROLLING MILL BOTH USING ROLL SHIFT AND ROLL BEND AND ROLL FOR USE THEREFOR

BACKGROUND OF THE INVENTION

1. Field of the Invention

The invention relates to a method for rolling a plate and a rolling mill using the method, and further to e roll to be used for such method and rolling mill, all of which utilize a roll shifting operation in which upper and lower work rolls are axially shifted in opposite directions to thereby roll a plate, in combination of roll bending operation in which a force is applied to bend the upper and lower work rolls to thereby roll a plate.

2. Description of the Related Art

Japanese Patent Publication No. 63-62,283 and Japanese Unexamined Patent Public Disclosure No. 1-266,902 have suggested a rolling mill which controls a cross-section of a plate to be rolled across its width to thereby provide the plate with a flat surface. As illustrated in FIG. 1 (Prior Art), the roll shifting type rolling mill is adapted to roll a plate 2 with upper and lower work rolls 1 that are axially shifted in opposite directions indicated by arrows A and B.

These conventional roll shifting type rolling mills have the following problems. In these conventional roll shifting type rolling mills, the upper and lower work rolls 1 are provided with an initial crown in order to apply the crown control effect to all plates ranging in width from wide to narrow. Thus, if the crown control effect is to be enhanced for a plate having a narrow or intermediate width, the upper and lower work rolls 1 have to be enlarged in parallel. Such an enlargement of the work rolls 1 is accompanied by excessive difference in roll diameter of the upper and lower work rolls in the axial direction, which in turn causes an excessive difference in both peripheral speed and surface pressure of the work rolls, resulting in oscillation and/or damage to a plate to be rolled.

Crown control by means of a roll bending mechanism or apparatus as illustrated in FIG. 2 (Prior Art) can provide only small control effects to a plate having an intermediate or narrow width due to the characteristics of the deflection curve of the roll.

Thus, the above mentioned conventional rolling mills have a problem in that they can provide only a small crown control effect to a plate having an intermediate or narrow width. In other words, as illustrated in FIG. 3A, the plate crown control effect caused by roll shift operation is relatively large in a plate having a wide width, and relatively small in a plate having a width ranging from intermediate to narrow. In addition, as illustrated in FIG. 3B, in the roll bend apparatus illustrated in FIG. 2, the plate crown control effect caused by a roll bend operation is relatively large in a plate having a wide width, while relatively small in a plate having an intermediate to narrow width. Hence, as illustrated in FIG. 3, even if the crown control effect caused by a roll shift operation is combined with the crown control effect caused by a roll bend operation, the combined crown control effect is relatively small in a plate having an intermediate to narrow width, while excessive in a plate having a wide width.

In addition, as illustrated in FIG. 4, if the curvature of a middle portion of rolls 1 is considerably changed in order to apply a larger crown control effect to a plate to be rolled having an intermediate to narrow width by using a conventional roll shift operation, the difference in a roll diameter between larger diameter portions indicated as D3 and D4 and smaller diameter portions indicated as D1 and D2 becomes larger with the result that the pressure at which the rolls 1 are in contact with back-up rolls 6 becomes excessive thereby possibly causing rolling defects.

Thus, the inventors have invented a roll for use with a rolling mill and have filed with Japan Patent Office, on Feb. 25, 1994, Japanese Patent Application No. 6-27085, which is not prior art to the present invention. In this rolling mill, a plate to be rolled is kept inclined during rolling to thereby provide larger variability of the curvature of the external surface of the roll barrel, larger crown control and less oscillation of the plate to be rolled.

As illustrated in FIG. 5, the above-mentioned roll has a single straight region 3 located at the center of a roll barrel, auxiliary crown control regions 4 located at the opposite ends of the roll barrel, and primary control regions 5 located between the straight region 3 and the auxiliary crown control regions 4. The roll has a bus comprising a straight line inclined to a long axis of the roll barrel in the straight region 3, steep convex or concave curvatures in the primary crown control regions 5, and gentle convex or concave curvatures in the auxiliary crown control regions 4. In addition, the roll is designed to have opposite ends having an equal diameter. The rolling mill disclosed in Japanese Patent Application No. 6-27085 surely makes it possible to enhance the crown control effect for a plate having an intermediate or narrow width and to further prevent the above-mentioned excessive difference in roll diameter. However, the rolling mill in question may be accompanied by irregularities in distribution of plate width of wide width plates with the result that the distribution of widths is not smooth.

It is therefore an object of the present invention to solve the above mentioned problems. Specifically, one of objects of the invention is to provide a method for rolling a plate and a rolling mill which imparts enhanced crown control effect to a plate with a small difference in a roll diameter, and capable of use with intermediate or narrow widths, and which provides a smooth distribution of plate width even in plates having wide widths.

A variety of rolling mills have been suggested for flattening a rolled plate by controlling cross-sectional shape of a plate to be rolled in the widthwise direction of such a plate. One of such rolling mills is known as a roll shift type rolling mill. For instance, Japanese Unexamined Patent Public Disclosure No. 1-266902 has suggested a roll shift type rolling mill, as illustrated in FIG. 6A, which shifts a pair of upper and lower work rolls 1 in opposite axial directions to thereby roll a plate 2 with the upper and lower work rolls 1 being supported by back-up rolls 6.

The upper and lower work rolls 1 in this rolling mill are designed to have an initial crown so that the upper and lower work rolls 1 have curved contours which are complementary to each other, in order to provide greater plate crown control effect to the plate 2 to be rolled. Thus, depending on the direction in which the upper and lower work rolls 1 are shifted, the plate crown applied to the plate 2 is a concave crown as illustrated in FIG. 6B or the convex crown as illustrated in FIG. 6C.

The rolling mill can vary the plate crown by shifting the work rolls 1 to thereby widen the controllable range. However, in actual rolling, there are several factors which may deteriorate rolling performance (such factors will be discussed with reference to FIG. 15A, 15B and 15C). The rolling mill has no countermeasures against such factors. One of such factors is that, as illustrated in the left figure of FIG. 15C, the surface pressure at roll ends is increased by the roll shift operation with the result that it is not possible to set the plate crown to be optimum.

In addition to the above mentioned factor, the factors which deteriorate rolling performance include a heat crown effect, as illustrated in FIG. 15A, which is caused by heat applied to the rolls, and deflection of the rolls caused by rolling load applied to the rolls as illustrated in FIG. 15B. In actual rolling, these factors affect the rolling alone or in combination, whereby it is not possible to set the plate crown to be optimum.

In view of the foregoing problems of the prior art, another object of the present invention is to provide a roll to be used with a roll shift operation, which compensates for factors which deteriorate rolling performance. It is a further object to provide a roll which provides a roll crown to deal with every rolling condition, and also to provide a roll shift type rolling mill using such a roll.

SUMMARY OF THE INVENTION

In accordance with a preferred embodiment, there is provided a roll adapted for use as an upper or lower work roll in a rolling mill for rolling a plate using a roll shift operation axially shifting the upper and lower work rolls. The roll has first and second ends, a first contour for varying the plate crown of a rolled plate in dependence on an amount of axial shifting, and a second contour superimposed on the first contour for compensating for rolling defects.

The first contour preferably comprises portions proximal to the first and second ends, having a roll diameter decreasing toward the ends.

The second contour preferably compensates for at least one of roll heat crown, roll deflection caused by a rolling force and increased surface pressure caused by the roll shifting.

In a second embodiment there is provided a roll for rolling a plate adapted for use in a rolling mill utilizing both roll shifting and roll bending. The roll has two ends, a length, a longitudinal center substantially dividing the length in half, and a first contour of varying roll diameter. The first contour comprises:

a first region having two ends, being disposed straddling the longitudinal center, and having a roll diameter increasing in a direction from one end of the first region to the other;

a second region located contiguous to each end of the first region, having a first end proximal to the first region and a second end distal to the first region, and having a roll diameter that changes from the first end in a direction equal to the direction of change of the first region, stops changing at an intermediate point, and reverses direction from the intermediate point until the second end;

a third region contiguous to each second region, having a first end proximal to the second end of the second region and a second end distal to the second region, and having a roll diameter changing from the first end to the second end in a direction opposite to the change in diameter of the first region, a fourth region contiguous to each third region, having a first end proximal to the second end of the third region and a second end distal to the third region, and having a change in roll diameter from the first end to the second end in the same direction as in the third region but with a smaller gradient; and a fifth region located contiguous to each fourth region, wherein the roll diameter is kept substantially constant to the diameter at the distal end of the fourth region, or the fifth may have a first end proximal to the second end of the fourth region and a second end distal to the fourth region, and have a change in roll diameter from the first end to the second end in the same direction as the first region.

The second embodiment of the roll preferably comprises a second contour, superimposed on the first contour, for compensating for a rolling defect selected from at least one of roll heat crown, roll deflection caused by a rolling force and increased surface pressure caused by roll shifting.

The roll of the second embodiment is preferably adapted to produce a plurality of different crowns in plates having a width substantially less than the length of the roll, and adapted to produce a smooth distribution of plate widths.

Another aspect of the embodiment provides a method for rolling a plate comprising the steps of rolling a plate, carrying out a combination of roll shifting and roll bending while rolling, said method being carried out by a rolling mill comprising:

upper and lower work rolls, each having first and second ends, a first contour for varying the plate crown in dependance on an amount of roll shifting, and a second contour, superimposed on the first contour, for compensating for rolling defects;

a roll bend device connected to the upper and lower work rolls adapted to apply force to and bend the work rolls; and a roll shift device connected to the upper and lower work rolls and adapted to axially shift the work rolls.

The method of the invention utilizes any of the preferred rolls described above.

In yet another aspect of the invention, there is provided a rolling mill comprising:

upper and lower work rolls, each having first and second ends, a first contour for varying the plate crown in dependance on an amount of roll shifting, and a second contour, superimposed on the first contour, for compensating for rolling defects;

a roll bend device connected to the upper and lower work rolls adapted to apply force to and bend the work rolls; and a roll shift device connected to the upper and lower work rolls and adapted to axially shift the work rolls.

The rolling mill according to the present invention can incorporate any of the preferred rolls as described above. In a preferred embodiment, the rolling mill comprises:

(1) an upper work roll having two ends, a length, a longitudinal center substantially dividing the length in half, and a contour of varying roll diameter, the contour comprising:

(a) a first region having two ends, being disposed straddling the longitudinal center, and having a roll diameter increasing in a direction from one end of the first region to the other;

(b) a second region located contiguous to each end of the first region, having a first end proximal to the first region and a second end distal to the first region, and having a roll diameter that changes from the first end in a direction equal to the direction of change of the first region, stops changing at an intermediate point, and reverses direction from the intermediate point until the second end;

(c) a third region contiguous to each second region, having a first end proximal to the second end of the second region and a second end distal to the second region, and having a roll diameter changing from the first end to the second end in a direction opposite to the change in diameter of the first region, (d) a fourth region contiguous to each third region, having a first end proximal to the second end of the third region and a second end distal to the third region, and having a change in roll diameter from the first end to the second end in the same direction as in the third region but with a smaller gradient; and (e) a fifth region located contiguous to each fourth region, wherein the roll diameter is kept substantially constant to the diameter at the distal end of the fourth region, the fifth region may also have a first end proximal to the second end of the fourth region and a second end distal to the fourth region, and have a change in roll diameter from the first end to the second end in the same direction as the first region;

(2) a lower work roll having two ends, a length, a longitudinal center substantially dividing the length in half, and a first contour of varying roll diameter substantially equivalent to the first contour of the upper work roll, except rotated by 180°;

(3) a roll bend device mechanically connected to each of the upper and lower work rolls and adapted to apply force to and bend the upper and lower work rolls;

(4) a roll shift device connected to the upper and lower work rolls and adapted to axially shift the upper and lower work rolls; and (5) a back-up roll for supporting each of the upper and lower work rolls.

The invention uses a combination of roll shift operation and roll bend operation. In accordance with the invention, the roll to be used for roll shift operation is formed to have a gentle curvature towards ends thereof because a roll deflection curvature caused by roll bend operation is to be added to a plate having a wide width. In addition, the roll is designed to have a narrower spacing between inflection points in a central portion thereof to thereby enhance plate crown changability caused by roll shift operation of a plate to be rolled having a middle or narrow width.

In accordance with the invention, a bus of work rolls comprises five regions including a first region to a fifth region. Since the roll bending effect is rather small in rolling a plate having a middle or narrow width, the work rolls are designed to have inflection points disposed closer to a center thereof so that the crown control effect caused by roll shift operation is enhanced.

Furthermore, since the crown control effect caused by roll bend operation in rolling a plate having a wide width is relatively large, the work rolls are designed to have either end portions having a gentle curvature or almost cylindrical contour for providing inverse inflection points to the work rolls, to thereby prevent a greater difference in a roll diameter. Thus, the plate crown control effect caused by roll shift operation is reduced for a plate having a wide width. Accordingly, a deflection curve caused by roll bending is added in the vicinity of the work roll ends to a gentle curve which is located in the vicinity of the work roll ends and which appears in the roll shift operation, resulting in that the thickness profile of a plate is made smooth at a place where the work rolls are in contact with the plate to be rolled. In addition, since it is possible to dispose the inflection points of the work rolls nearer to each other, the crown control effect can be enhanced for a plate having an intermediate or narrow width.

Thus, the roll varies the plate crown so as to compensate for rolling defects, and enables optimum roll shift type rolling by means of the above mentioned contour without rolling defects.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

Figure 1:
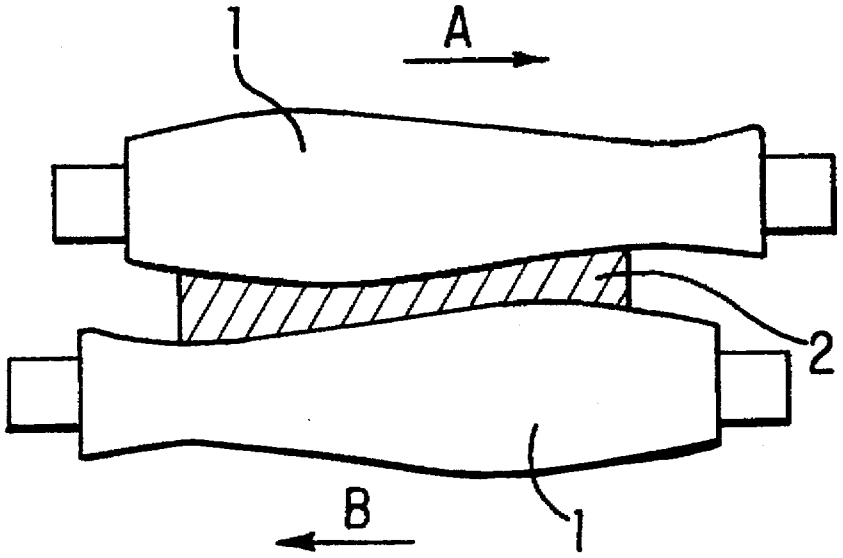
FIG. 1 Prior Art
FIG. 1 (Prior Art) is a schematic view illustrating a conventional roll shifting type rolling mill.
Figure 2:
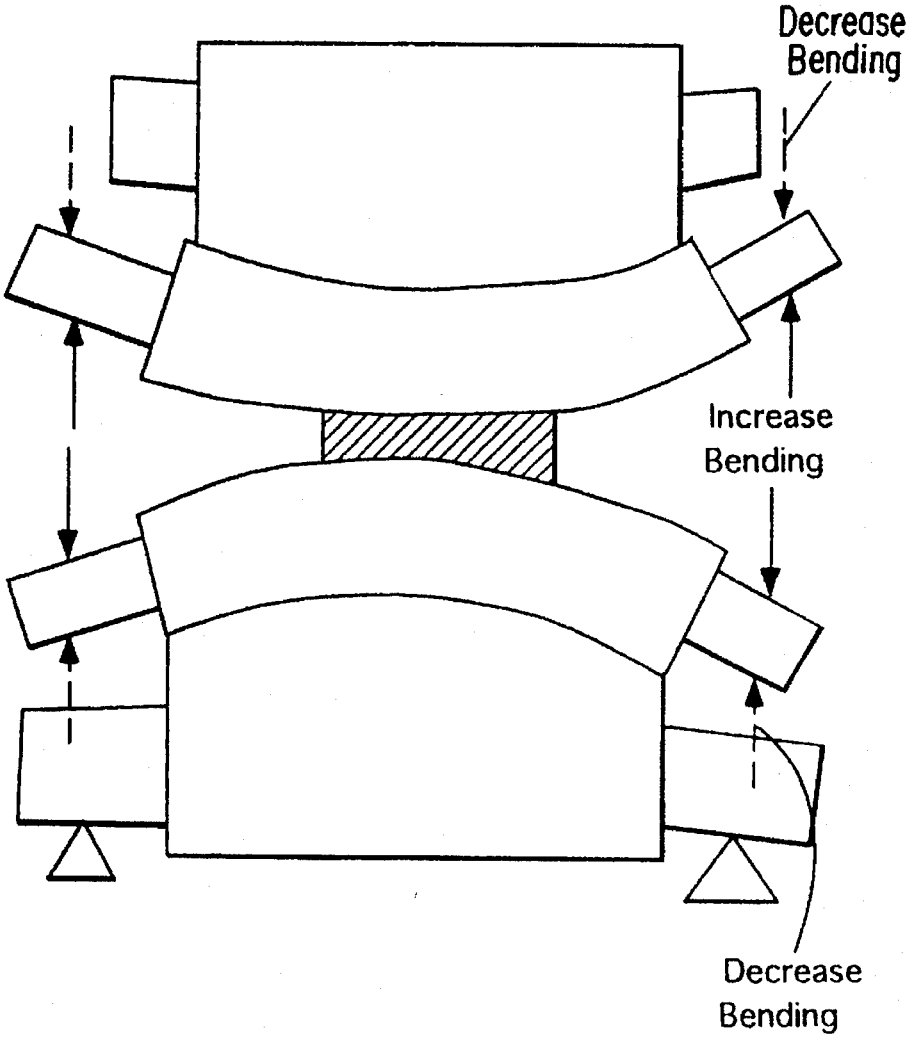
Fig.2 Prior Art
FIG. 2 (Prior Art) is a schematic view illustrating deflection control by means of work roll bending.
Figure 3A:
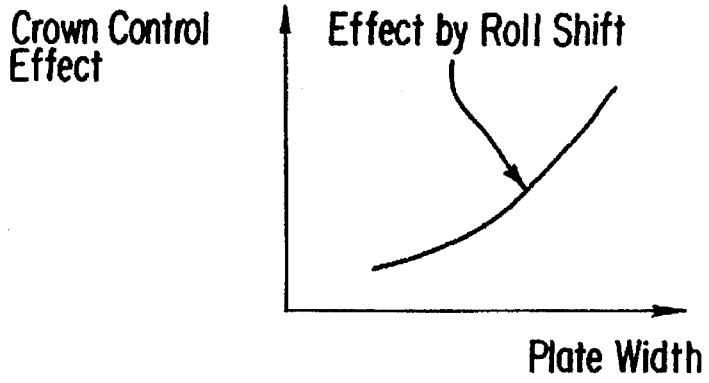
FIG. 3A is a graph showing the crown control effect caused by a roll shifting operation for a plate having an intermediate or narrow width by means of a conventional rolling mill.
Figure 3B:
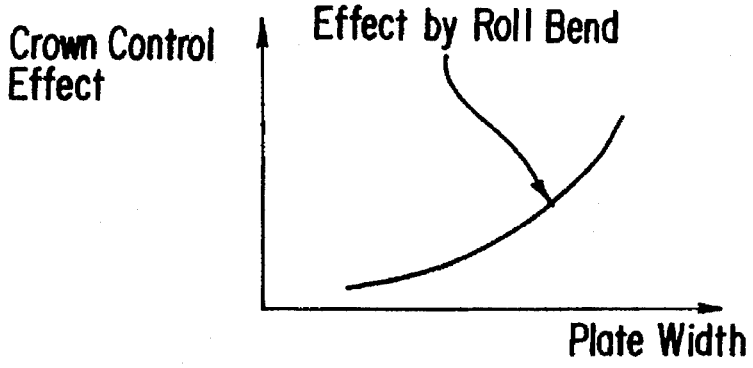
FIG. 3B is a graph showing the crown control effect caused by a roll bending operation for a plate having an intermediate or narrow width by means of a conventional rolling mill.
Figure 3C:
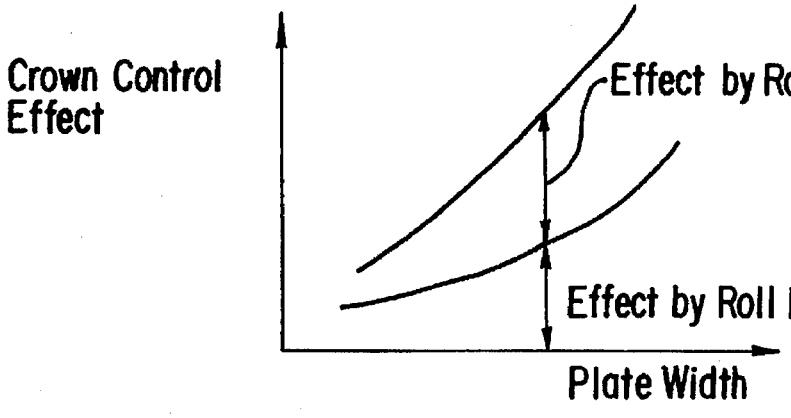
FIG. 3C is a graph showing the crown control effect caused by both roll shifting and roll bending operations for a plate having an intermediate or narrow width by means of a conventional rolling mill.
Figure 4:
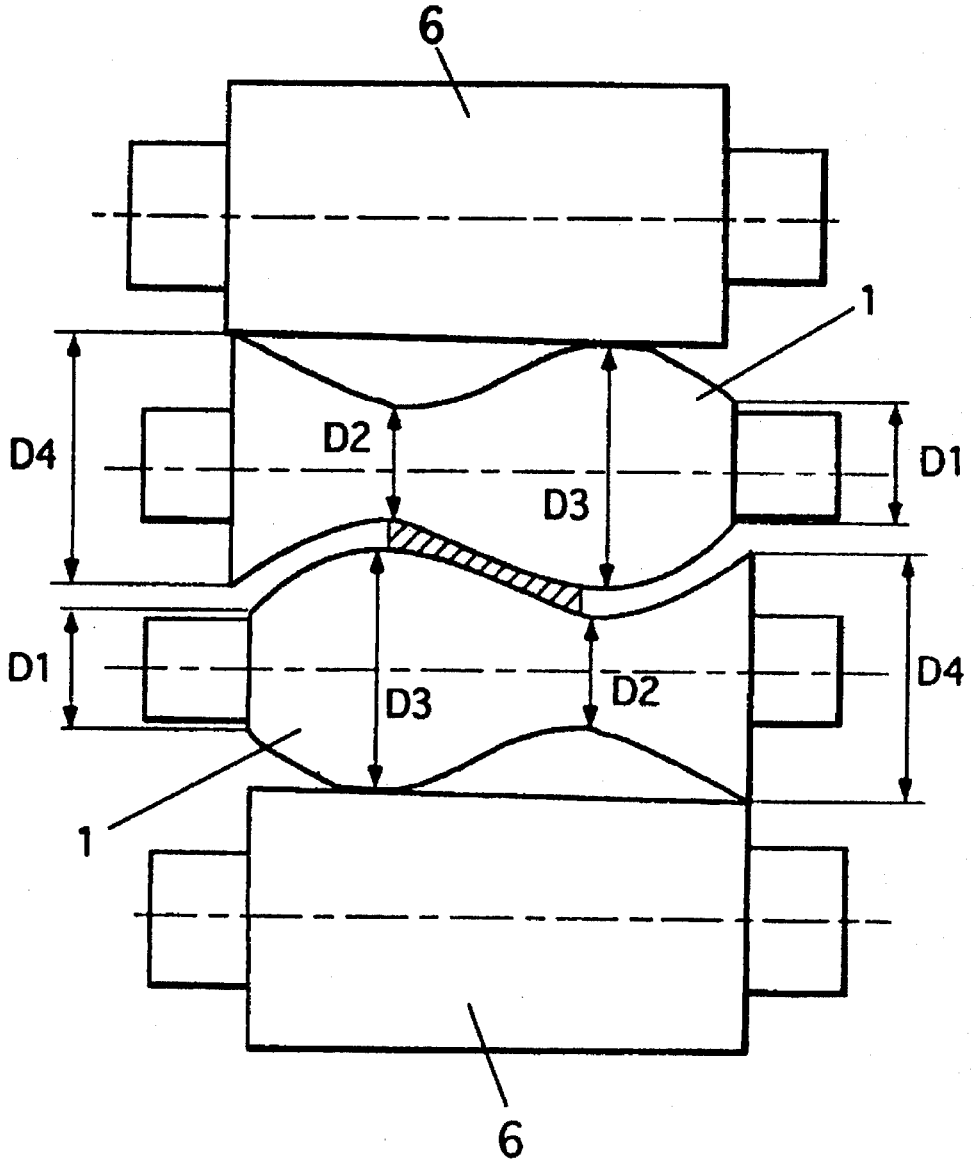
FIG. 4 schematically illustrates a problem with a conventional rolling mill when the crown control effect is enhanced for a plate having an intermediate or narrow width.
Figure 5:
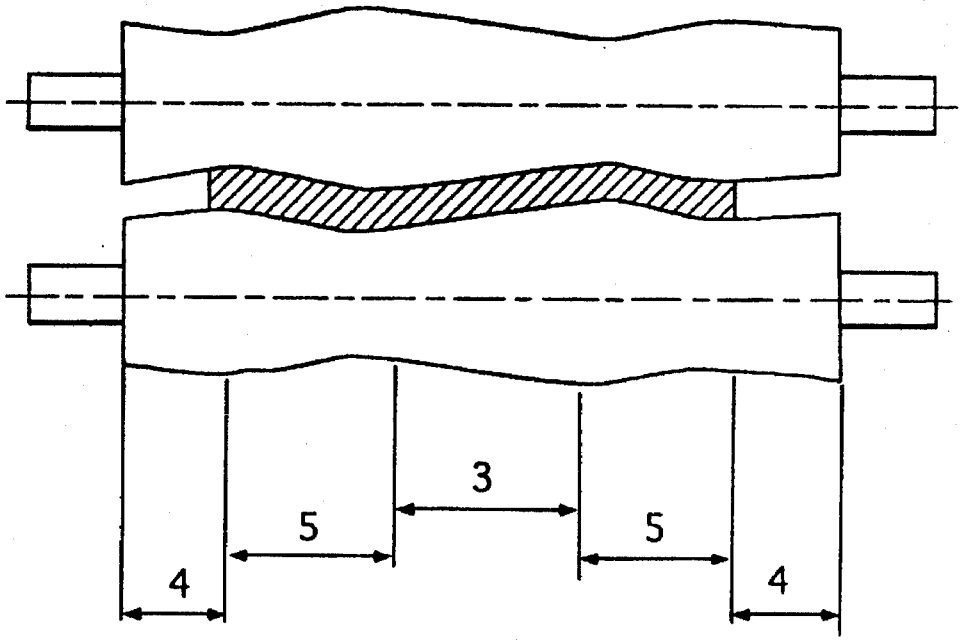
FIG. 5 is a schematic view illustrating a roll invented by the present inventors for use with a rolling mill, which is not prior art to the present invention.
Figure 6A:
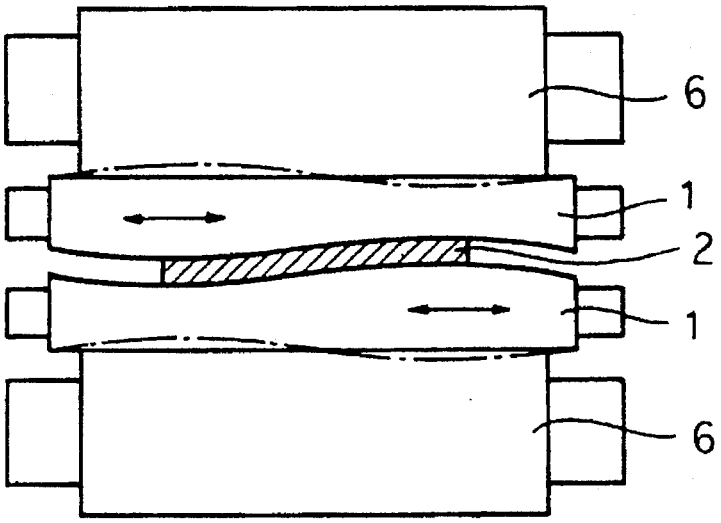
Fig.6A Prior Art
FIGS. 6A, 6B and 6C (Prior Art) are schematic views illustrating crown control in a conventional roll shifting type rolling mill.
Figure 6B:
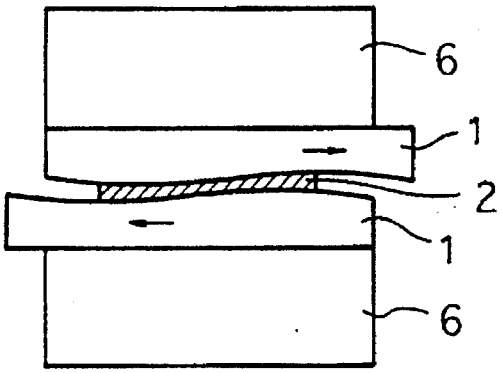
Fig.6B Prior Art
Figure 6C:
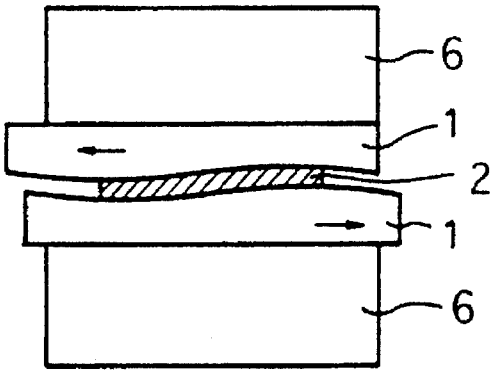
Fig.6C Prior Art
Figure 7:
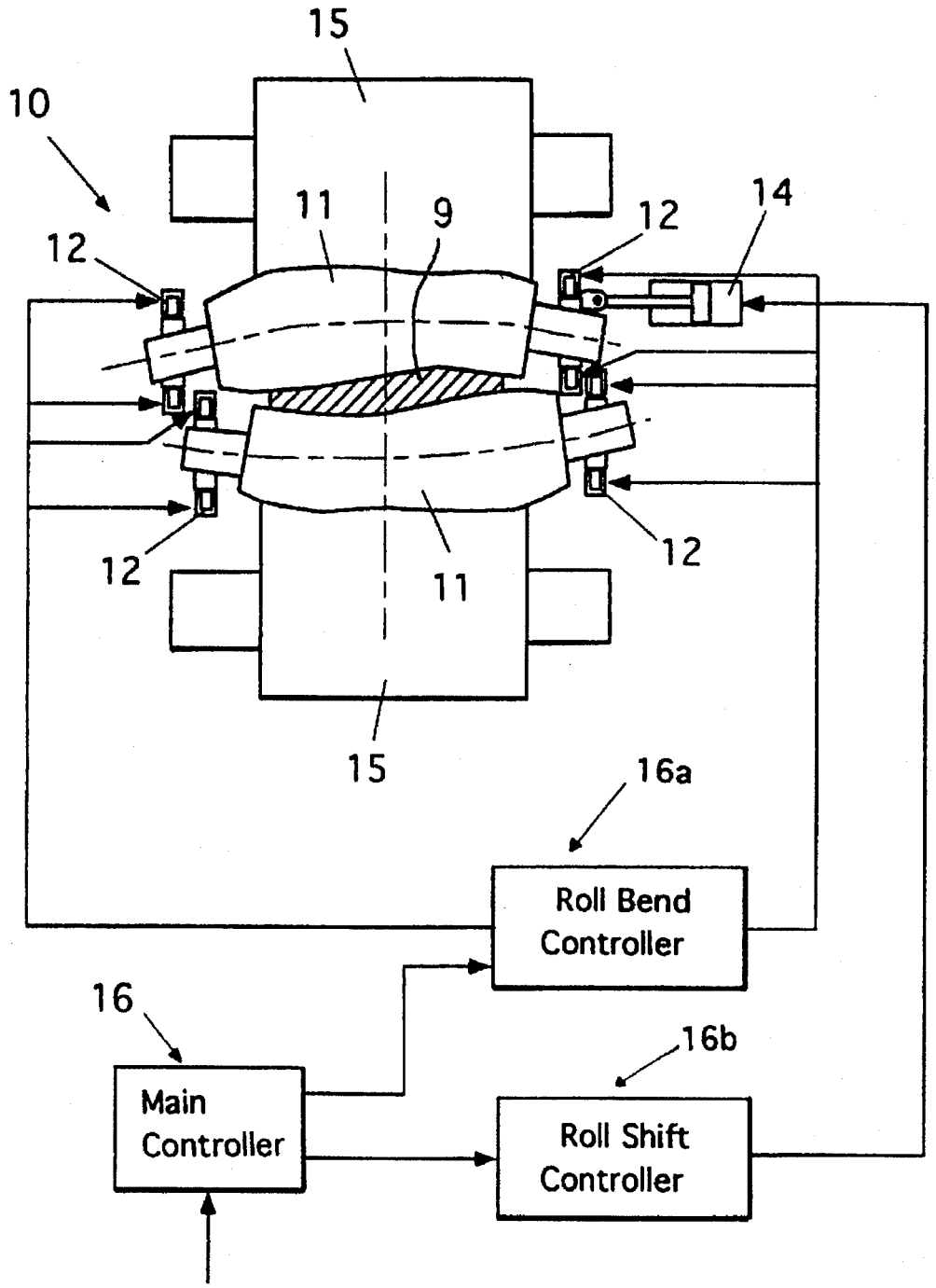
FIG. 7 is a schematic view illustrating a rolling mill in accordance with the invention, in which both roll shifting and roll bending are to be carried out.

FIG. 7 illustrates a rolling mill in accordance with an embodiment of the invention, which carries out both roll shifting and roll bending operations. A rolling mill 10 in accordance with the embodiment includes upper and lower work rolls 11, a roll bending device 12 for applying a bending force to the upper and lower work rolls 11, and a roll shifting device 14 for axially shifting the upper and lower work rolls 11 in opposite directions. The work rolls 11 are supported by back-up rolls 15. The work rolls 11 may be supported by intermediate rolls (not illustrated) in place of the back-up rolls 15. The rolling mill 10 simultaneously carries out both roll bending and roll shifting operations. The plate 9 is rolled by using both the roll bending device 12 and the roll shifting device 14.

The rolling mill 10 is further provided with a main controller 16 which determines the appropriate combination of roll shift and a roll bending force depending on a width of the plate 9, and emits a signal representing such combination to the roll bending device 12 and the roll shifting device 14 through a roll bending controller **16*a* and a roll shifting controller 16*b*, respectively. Thus, it is possible to optimally set roll shift of the work rolls 11 and the bending force applied to the work rolls 11 depending on the thickness of the plate 9**.

Figure 8:
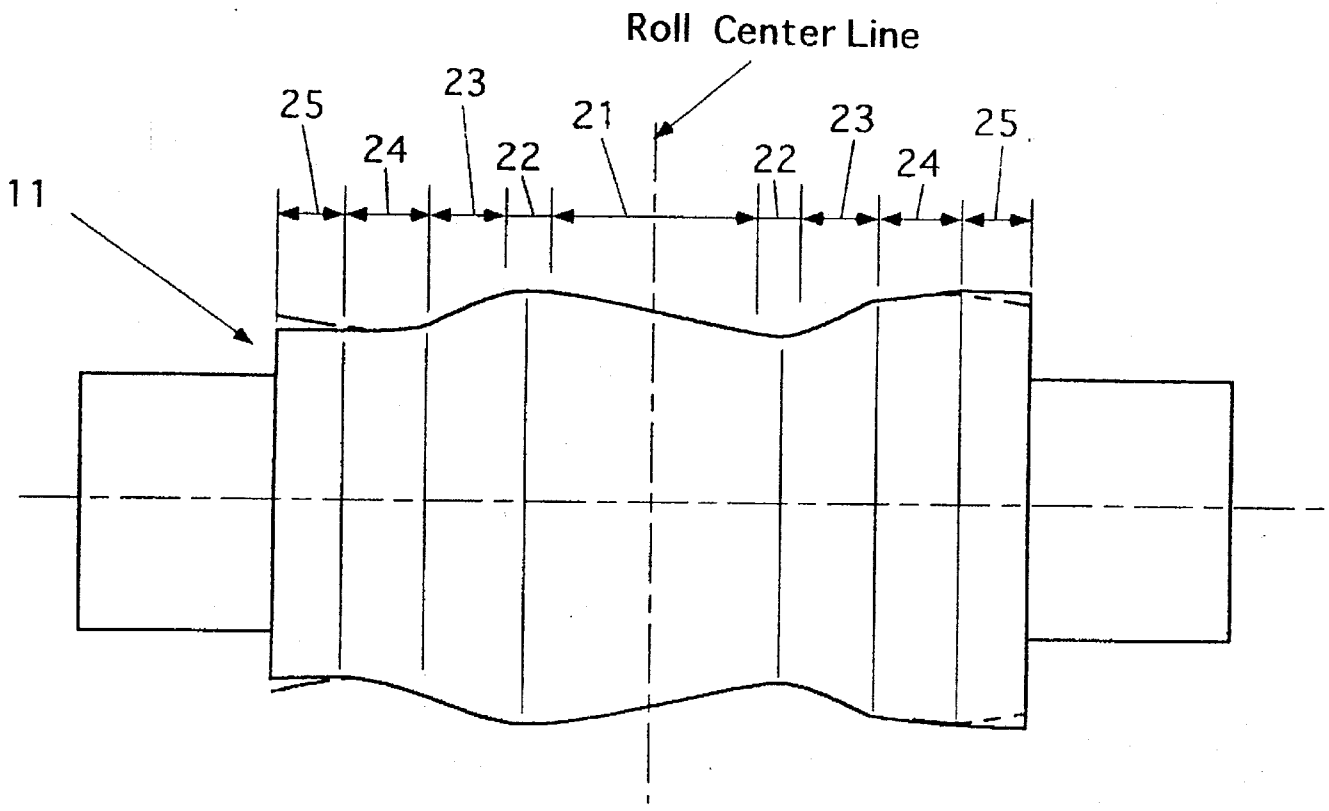
FIG. 8 is a schematic view illustrating a contour of a work roll in accordance with the invention.

FIG. 8 illustrates an enlargement of the contour of the work roll 11. As illustrated therein, each of the upper and lower work rolls 11 has a bus having a contour comprising five regions: a first region 21, second regions 22, third regions 23, fourth regions 24 and fifth regions 25.

The first region 21 is located straddling a longitudinal center of each of the upper and lower work rolls 11. In the first region 21, the diameter of the work roll 11 increases or decreases in a direction from one of the regions longitudinal ends to the other, depending on whether the upper work roll, or the lower work roll is referred to. The second regions 22 are located contiguous to and at opposite sides of the first region 21. In the second regions 22, the diameter of the work roll 11 decreases if the first region 21 increases and decreases if the first region 21 increases. The third regions 23 are located contiguous to each of the second regions 22. In the third regions 23, the diameter of each of the work roll 11 decreases or increases; the diameter of the work roll 11 in the third regions varies in a direction opposite to the direction that the diameter varies in the first region 21. The fourth regions 24 are located contiguous to each of the third regions 23. In the fourth regions 24, the diameter of the work roll 11 decreases or increases in the same direction as that of the third regions 23, but to a smaller degree or with a smaller rate than in the third regions 23. The fifth regions 25 are located contiguous to each of the fourth regions 24. In the fifth regions 25, the diameter of the work roll 11 is either kept almost the same as that of the fourth region 24 so that the fifth regions 25 are generally cylindrical in shape, or the diameter of the work roll in the fifth regions 25 varies in the same direction as in the first region 21.

Work rolls 11 having the above-mentioned structure make it possible to provide a greater controllability of the plate crown effected by roll shifting on a plate with an intermediate or narrow width. In addition, the use of a combination of roll shifting and roll bending causes the contour of the upper and lower work rolls to overlap deflection of the work rolls caused by roll bending, resulting in a diameter profile in the direction of the width of the plate to be rolled which is smooth where the upper and lower work rolls contact the plate to be rolled.

The reason why the work rolls 11 have a contour having concavities and convexities as illustrated in FIG. 8 is to make the sum of deformation of the work rolls caused by roll shifting and deformation of the work rolls caused by roll deflection to be a smooth profile, and further to enhance the plate crown caused by roll shifting in a plate having an intermediate width.

Figure 9A:
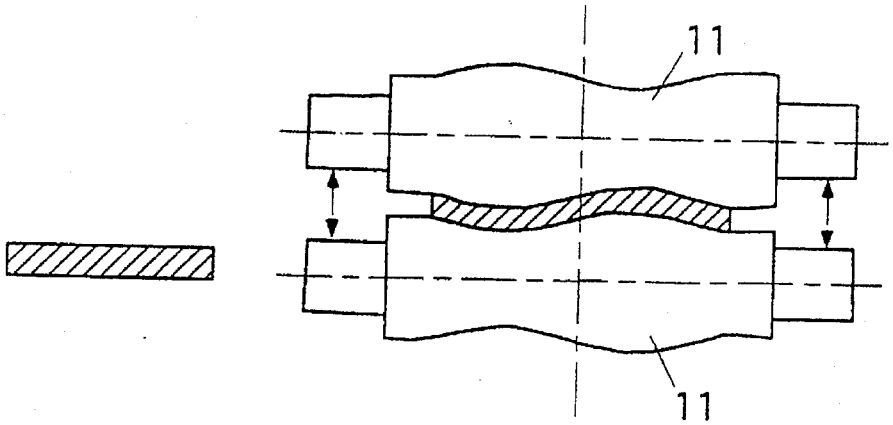
FIGS. 9A, 9B and 9C show the crown control effected by work rolls in accordance with the invention.
Figure 9B:
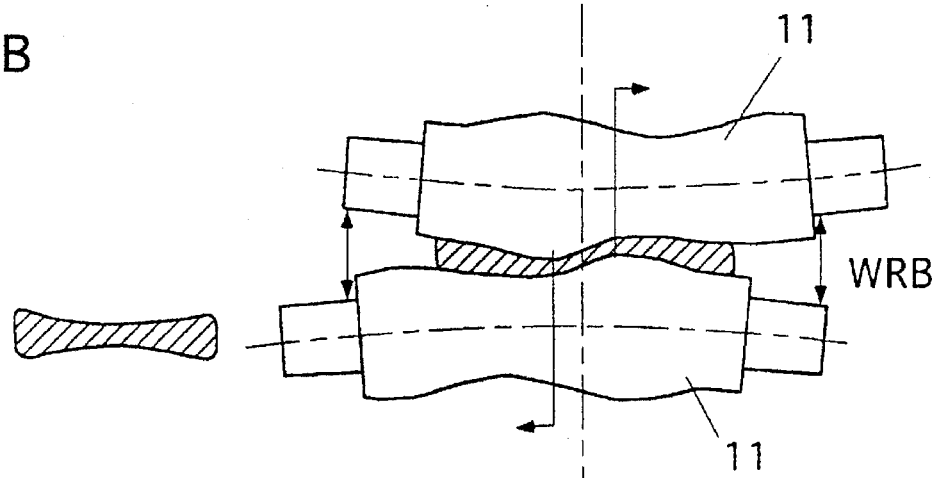
Figure 9C:
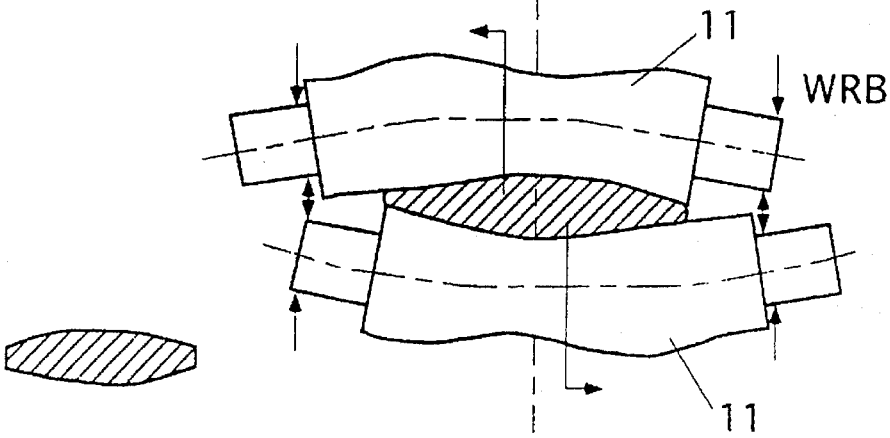

FIGS. 9A, 9B and 9C show the crown control effects obtained by using the work rolls 11 illustrated in FIG. 8. FIG. 9A shows a state in which roll shifting is not carried out, namely a flat crown state, whereas FIGS. 9B and 9C show a state in which both roll shifting and the roll bending are carried out. As illustrated in FIG. 9A, if there are no rolling loads and no roll shifting is carried out, the spacing between the upper and lower work rolls 11 along the width of the rolls can be maintained constant.

As illustrated in FIG. 9B, when the upper work roll 11 is shifted to the right, the lower work roll 11 is shifted to the left and the rolls 11 are bent externally, concave crown control can be carried out in which a plate to be rolled is made concave at a central portion. In contrast with FIG. 9B, as illustrated in FIG. 9C, when the upper work roll 11 is shifted to the left, the lower work roll 11 is shifted to the right, and rolls 11 are bent internally, convex crown control can be carried out in which a plate to be rolled is made convex at a central portion. A rolling mill is required to have crown changability for varying the plate thickness profile to be either convex or concave.

In addition, as illustrated in FIG. 8, the work rolls 11 can enhance the plate crown control effect caused by roll shift operation in rolling a plate having an intermediate or narrow width, because inflection points of the work rolls 11 are disposed closer to the center of the work rolls.

Figure 10A:
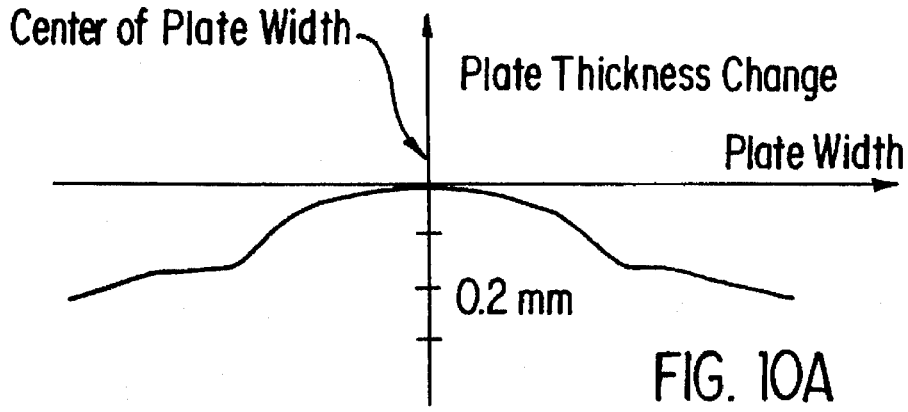
FIGS. 10A, 10B and 10C are graphs showing plate thickness profile (crown amount) provided by a rolling mill in accordance with the invention.
Figure 10B:
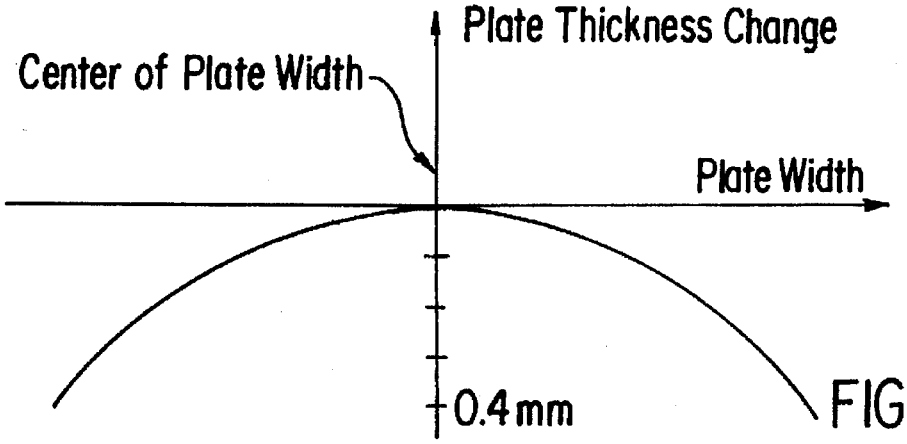
Figure 10C:
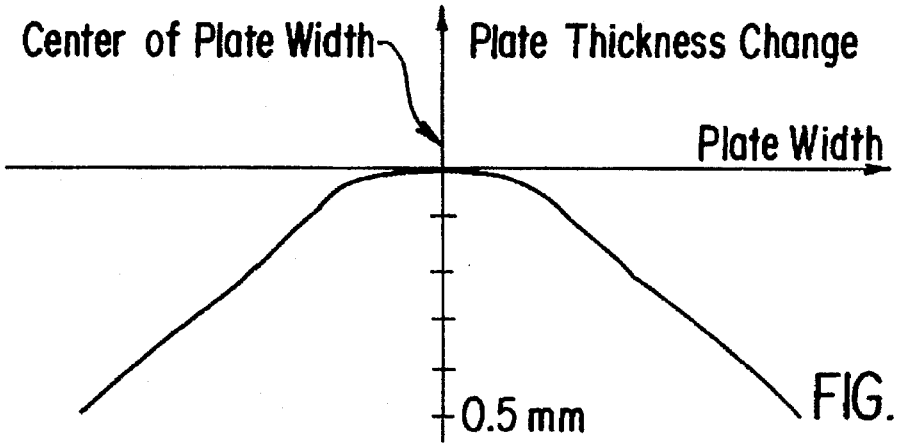

FIGS. 10A, 10B and 10C show the plate thickness profile or the dimensions of the crown obtained by the rolling mill in accordance with the invention. FIGS. 10A, 10B and 10C show the results of using work rolls 11 having a contour as illustrated in FIG. 8, specifically having a diameter of 730 mm and a length of 1830 mm, to roll a plate having a wide width, specifically a width of 1650 mm.

FIG. 10A shows a case in which the roll shift is set to be—40 mm and the roll bend is set to be zero. The maximum change in plate thickness is just about 0.2 mm, and some irregularities are found in the plate thickness profile. FIG. 10B shows a case in which the roll shift is set to be zero and the roll bend is caused by an internal load of 180 tons. The maximum change in plate thickness is about 0.4 mm. FIG. 10C shows a case in which the roll shift is set to be—40 mm and the roll bend is caused by an internal load of 180 tons. The maximum change in plate thickness is about 0.5 mm.

Accordingly, it can be found from FIGS. 10A, 10B and 10C that the use of both roll shift and roll bend operations enables forming a contour of the work roll to be gentler during roll shifting because the deflection curve of the work roll caused by roll bending is added to the contour when a wide width plate is rolled.

Figure 11:
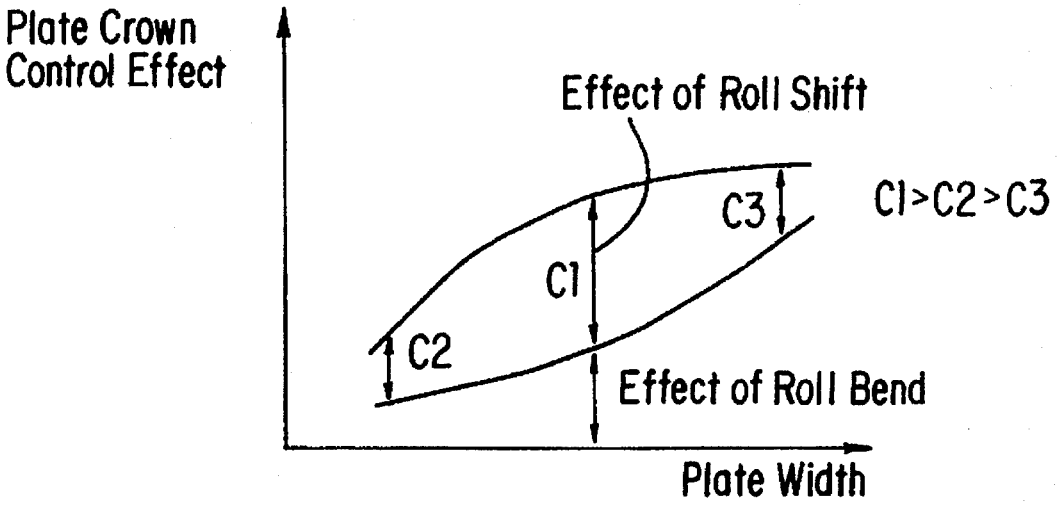
FIG. 11 is a graph showing the effect obtained by the present invention.

FIG. 11 schematically shows the effect obtained by the present invention. As will be understood from the FIG. 11, the invention enhances the crown control effect caused by roll shifting for a plate having an intermediate or narrow width. Accordingly, the use of a roll contour in accordance with the invention in combination with roll bend and roll shift operations makes it possible to enhance the crown control effect for a plate having an intermediate width. Furthermore, the present invention avoids rolling defects because the difference in roll diameter is relatively small. In addition, the use of the contour of the roll to enhance the crown control effect for a plate having an intermediate or narrow width in combination of the roll bend operation makes it possible to avoid non-uniform plate thickness occurring at the edges of wide plates.

Some embodiments can amplify the effects obtained by the invention. For instance, the plate crown control effect for a plate having an intermediate width can be greater and more sharp by providing third regions 23 with a steeper gradient in roll diameter than the roll diameter gradient of the first region. This is because the thickness profile is made more sharp at the edges of plates having an intermediate width.

Figure 12:
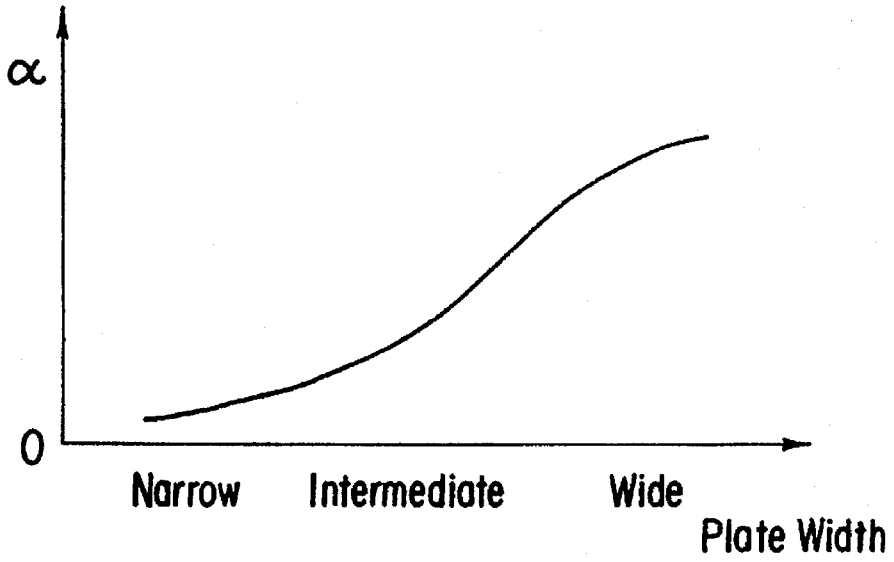
FIG. 12 is a graph showing a relationship between a plate width and a dimensionless number $\alpha$.

The combination of roll shifting with roll bending shown in FIG. 7 can be carried out, for instance, as shown in FIG. 12. By calculating roll bending and roll shifting in advance, there is first obtained a combination of roll shift amount and roll bend amount which would produce no convexities and concavities within the width of the plate. For instance, according to the calculation obtained by FIGS. 10A, 10B and 10C, the best combination for the rolling mill is 40 mm of roll shift and 180 tons of internal bending for a plate with a width of 1650 mm.

By repeating the above calculation for each plate width, there can be obtained a combination curve representing a relation between the work roll bending load PB and the shift stroke St. Provided that the work roll bending load PB and the shift stroke St is divided by constants PB0 and St0, respectively, to thereby make them to be dimensionless, a curve defining the following equation can be obtained from the above mentioned combination curve, as illustrated in FIG. 12.

$$PB/PB0=\alpha St/St0$$

The above mentioned function is required to keep a certain smoothness in the cross-section of the plate. In accordance with a desired cross-section of the plate, the roll bending and/or roll shifting may be additionally determined from the required function.

As aforementioned, in accordance with the invention, a contour of the work rolls comprises five regions from a first region to a fifth region. Since the roll bending effect is rather small in rolling a plate having an intermediate or narrow width, the work rolls are designed to have inflection points disposed closer to a center thereof so that the crown control effect caused by roll shift operation is enhanced.

Furthermore, since the crown control effect caused by roll bend operation in rolling a plate having a wide width is relatively large, the work rolls are designed to have end portions having a gentle curvature or almost horizontal plane or a contour for providing inverse inflection points to the work rolls, to thereby prevent a greater difference in roll diameter. Accordingly, a deflection curve caused by roll bending is added in the vicinity of the work roll ends to a curve appearing in the roll shift operation, resulting in smooth thickness profile of the plate where the work rolls are in contact with the plate to be rolled.

Thus, the method for rolling a plate and a rolling mill in accordance with the invention, using both roll shift and roll bend operations provides advantages including decreasing rolling defects and amplifying the plate crown control effect for plates having intermediate or narrow widths.

Figure 13A:
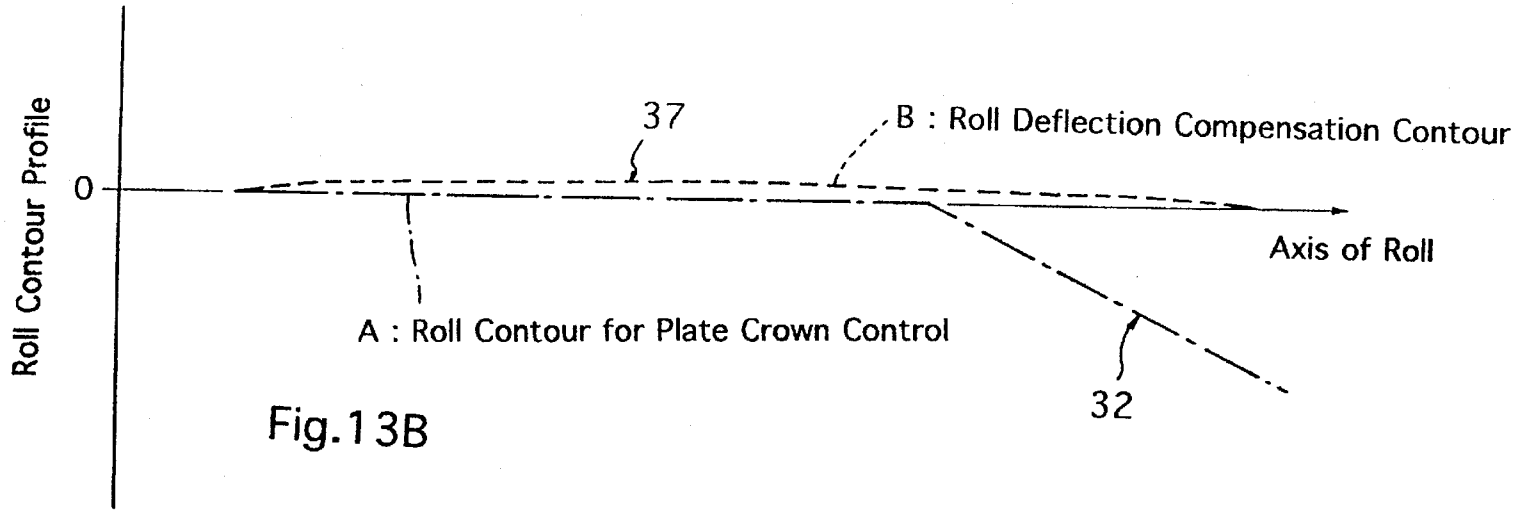
FIGS. 13A and 13B are enlarged views illustrating a part of a contour of a roll to be used for roll shift operation in accordance with the present invention.
Figure 13B:
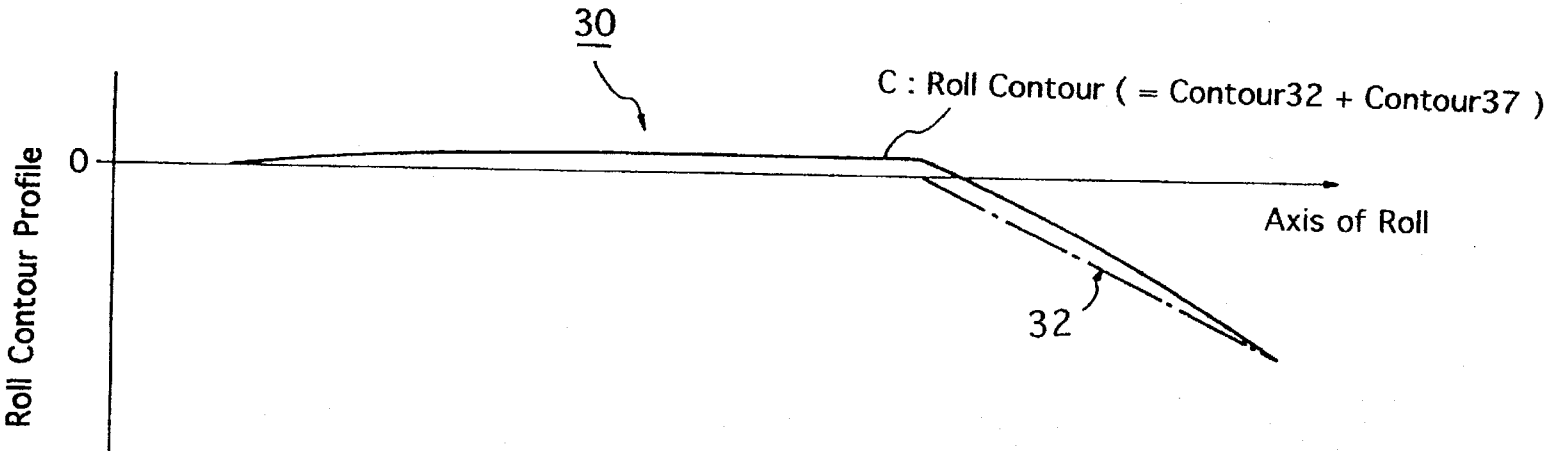
Figure 14A:
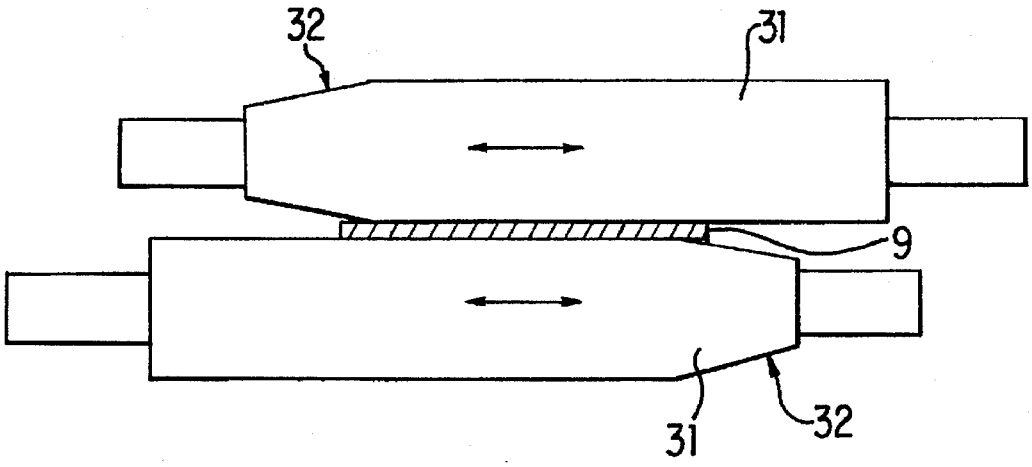
FIG. 14A is a schematic view illustrating a roll in accordance with the invention to be used for roll shifting and to vary the plate crown by roll shifting.
Figure 14B:
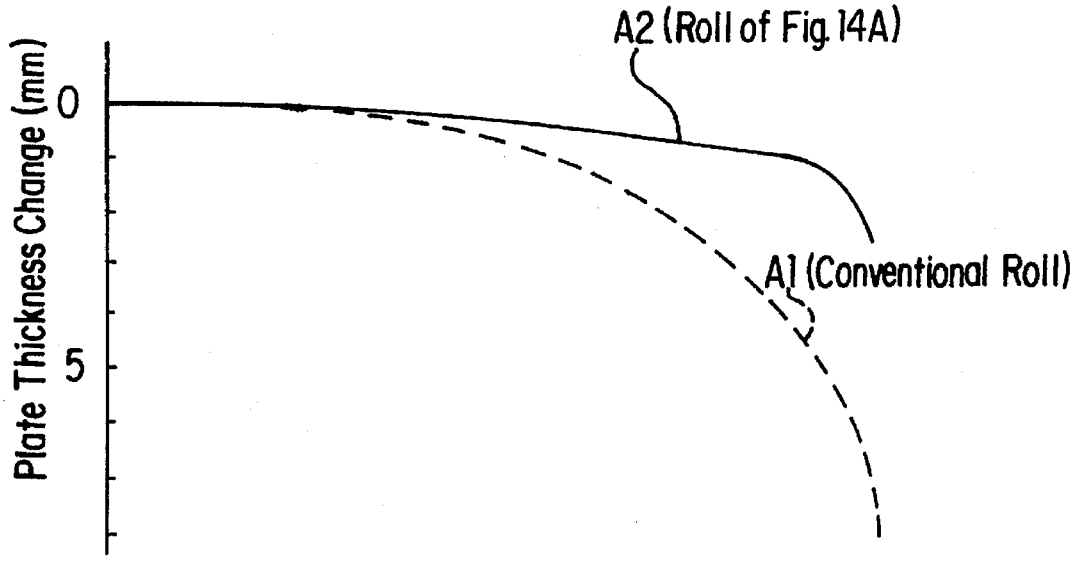
FIG. 14B is a graph showing the relationship between plate thickness and contours of a conventional roll and a roll in accordance with the invention.
Figures 1, 15A:
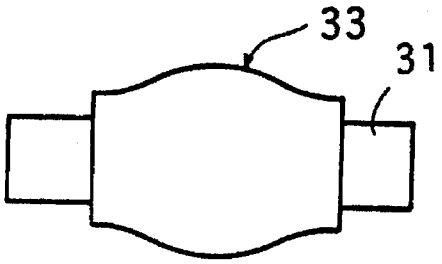
FIGS. 15A, 15B and 15C are schematic views illustrating rolling defects and contours of a roll in accordance with the invention for compensating for the rolling defects.
Figures 2, 15A:
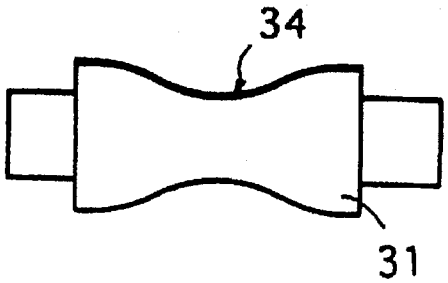
Figures 1, 15B:
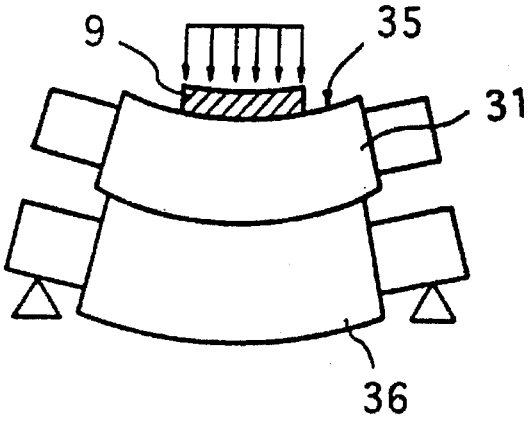
Figures 2, 15B:
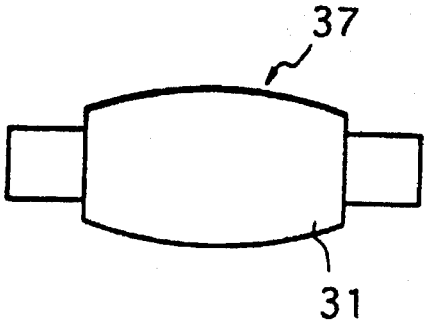
Figures 1, 15C:
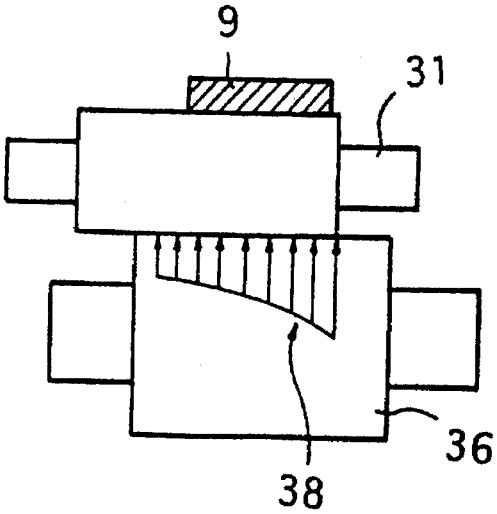
Figures 2, 15C:
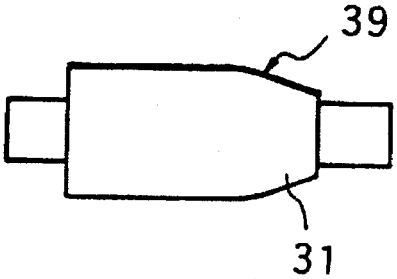

FIGS. 13A to 15C illustrate a roll to be used for roll shifting in accordance with an embodiment of the invention. FIGS. 13A and 13B are enlarged views illustrating a part of the contour of the roll. FIG. 14A is a schematic view illustrating the contour of the roll for varying the plate crown by roll shifting. FIG. 14B is a graph showing a relationship between plate thickness and the contour of a conventional roll. FIGS. 15A, 15B and 15C are schematic views illustrating rolling defects and roll contours for compensating for the rolling defects.

The roll in accordance with the embodiment has a contour comprising a first contour for varying the plate crown to thereby widen the controllable range of the plate crown through roll shifting, and a second contour for compensating for rolling defects which would otherwise occur in actual rolling.

The roll 30 to be used for roll shifting has a contour 32 as the above mentioned first contour. The contour 32 comprises ends of the upper and lower work rolls 31. The ends are oppositely located in an axial direction of the upper and lower work rolls, and the contours have a diameter decreasing towards the respective end of the upper and lower work rolls at which they are located. For instance, as illustrated in FIG. 14A, the upper work roll 31 has a left end having a reduced diameter, whereas the lower work roll 31 has a right end having a reduced diameter.

The upper and lower work rolls 31 are encased in a mill housing (not illustrated) together with upper and lower back-up rolls so that the work rolls can be shifted in an axial direction. Four rows of the upper and lower work rolls constitute a typical roll shift type rolling mill in which a plate is rolled with edges of the plate being disposed beneath or above the reduced diameter ends 32 of the upper and lower work rolls 31. The roll shifting is varied depending on the width of the plate 9 to be rolled.

By rolling a plate with the shifted upper and lower work rolls 31 each having the reduced diameter ends 32, contact pressure between the reduced diameter ends and the back-up rolls is made smaller, and hence a bending moment does not excessively exert on the work rolls 31. Thus, as illustrated in FIG. 14B, the work rolls 31 having the reduced diameter ends, indicated with a solid line A2, can provide more efficient plate crown control than conventional work rolls indicated with a broken line A1.

However, the use of the work rolls 31 having the reduced diameter ends 32 alone cannot provide optimal plate crown effect because the work rolls are influenced by rolling defects (see FIGS. 15A, 15B and 15C) which may occur in actual rolling. Thus, the rolling defects should be compensated for.

First, hereinafter will be discussed the rolling defects and a contour of a roll for compensating for the rolling defects with reference to FIGS. 15A, 15B and 15C.

One of the rolling is roll heat crown 33 as illustrated in FIG. 15A. The work rolls 31 are heated by plate 9 during a process such as hot rolling, for example. The work rolls 31 are likely to be cooled down at the ends, whereas the work rolls is less likely to be cooled down at the center. Thus, a heat crown 33 occurs in a central portion of the work rolls 31.

In order to compensate for the roll heat crown 33, as illustrated in the right figure in FIG. 15A, the work roll 31 is designed to have a heat crown compensation contour 34 in which the work roll 31 is formed to be concave at its central portion.

Another cause of rolling defects is a deflection 35 of a roll caused by a nominal rolling force. As illustrated in FIG. 15B, when a pressing force exerts on the lower work roll 31 and lower back-up roll 36, and rolls 31, 36 are deflected downwardly at their central portions, a roll deflection 35 results.

In order to compensate for the roll deflection 35, it is necessary to provide the work roll 31 with a contour which would offset the deflection of the work roll. For instance, as illustrated in the right figure in FIG. 15B, the lower work roll 31 is provided with a roll deflection compensation contour 37 in which the lower work roll 31 has a convex central portion.

Another cause of rolling defects is an increased surface pressure 38 at the ends of the work rolls. The increased surface pressure is caused by roll shifting. As illustrated in the left figure in FIG. 15C, when the ends of the lower work roll 31 are located in the vicinity of a central portion of the back-up roll 36 due to roll shifting, a surface pressure 38 at the ends of the lower work roll 31 becomes greater than a surface pressure at a central portion of the work roll 31.

In order to compensate for the increased surface pressure 38 caused by roll shifting, the work roll 31 is provided with a contour by which a plate can be rolled into a flat plate even though a surface pressure at the ends of the work roll 31 is increased. For instance, as illustrated in the right figure in FIG. 15C, the work roll 31 is provided with an increased surface pressure compensation contour 39 in which a roll diameter decreases towards the ends of the lower work roll.

One or more of the above-mentioned heat crown compensation contour 34, roll deflection compensation contour 37, and increased surface pressure compensation contour 39 may be combined with the above-mentioned roll contour 32 to serve as the plate crown control contour.

For instance, when roll shifting type rolling is carried out by means of the work rolls 31 having a plate crown control contour having reduced diameter ends 32, and at the same time, roll deflection 35 is to be compensated for, the work roll 31 is provided with a roll contour 30 indicated by a solid line C as illustrated in FIGS. 13A and 13B. Roll contour 30 is obtained by combining the contour 32, indicated by a chain line A, in which ends of the work rolls are reduced in diameter with the roll deflection compensation contour 37 indicated by a broken line B.

Thus, by combining the roll contour 32 for controlling the plate crown with roll deflection compensation contour 37 for compensating the roll deflection 35 caused by a nominal rolling force, it is possible to carry out roll shift type rolling while automatically compensating for deflection 35 caused by a nominal rolling force.

Accordingly, the combination of the roll contour 32 for controlling the plate crown with one or more of the roll contours 34, 37 and 39 for compensating for rolling defects makes it possible to carry out roll shift type rolling while compensating for various rolling defects by using various compensating contours alone (34, 37, 39) or in combination (34, 37; 34, 39; 37, 39; 34, 37, 39).

Hereinbelow will be explained a roll to be used for roll shifting in accordance with another embodiment with reference to FIGS. 16A to 16D and 17.

Figure 16A:
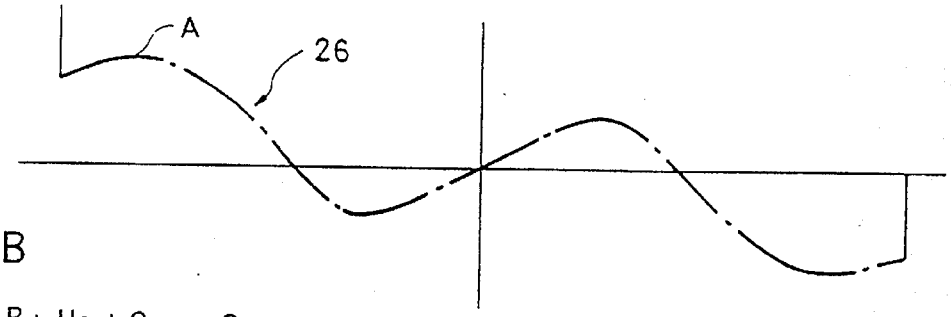
FIGS. 16A, 16B, 16C and 16D are enlarged views of a part of contours of rolls to be used for a roll shift operation in accordance with an embodiment of the invention.
Figure 16B:
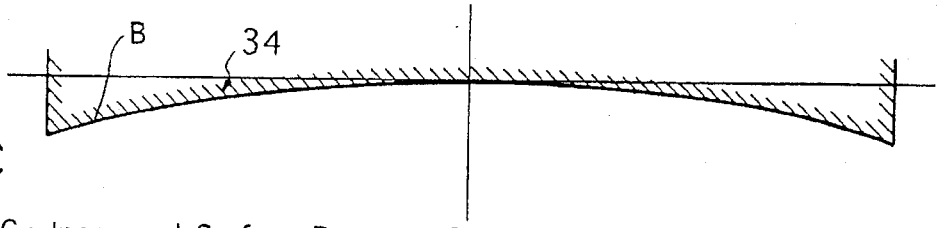
Figure 16C:
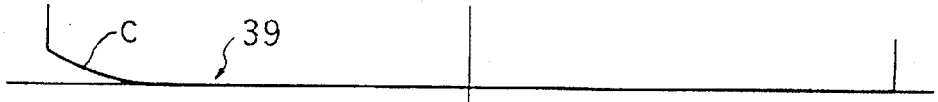
Figure 16D:
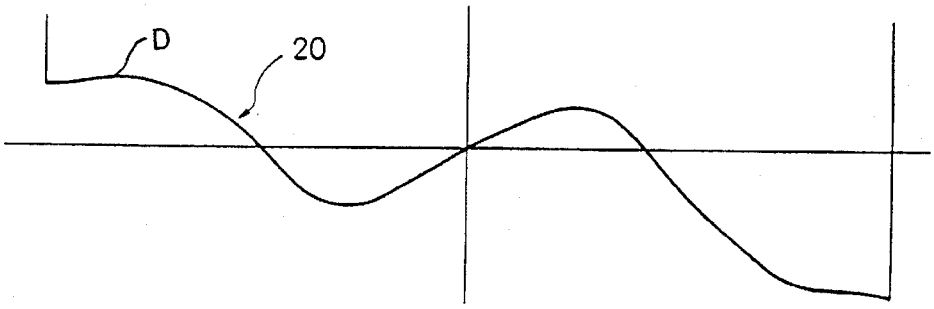
Figure 17:
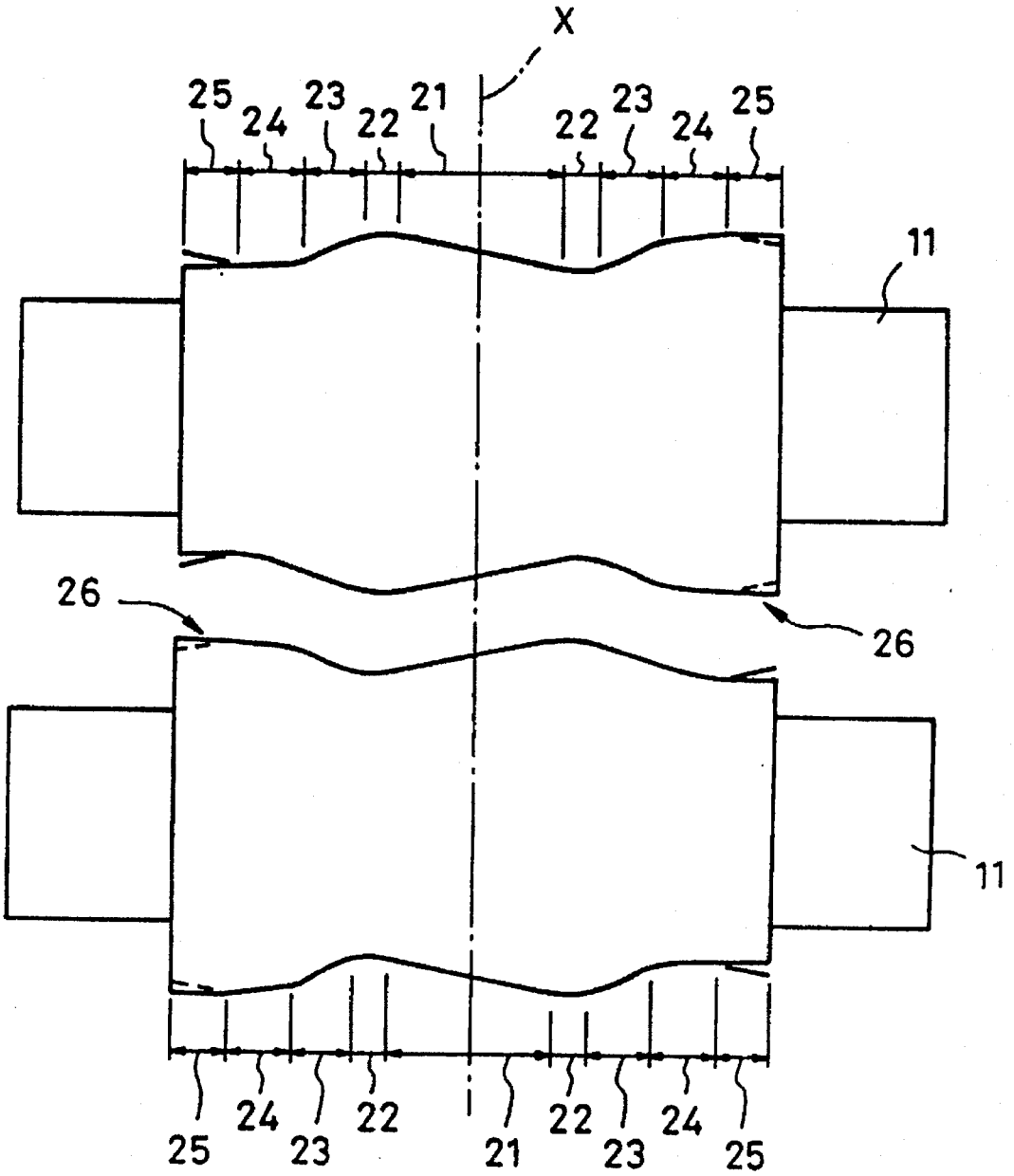
FIG. 17 is a schematic view illustrating a contour of a roll in accordance with an embodiment of the invention for varying the plate crown.

FIGS. 16A, 16B, 16C and 16D are enlarged views of a part of various roll contours, and FIG. 17 is a schematic view illustrating a contour of a roll for varying the plate crown by roll shifting.

A roll 20 in accordance with the embodiment to be used for roll shifting has a different contour for varying the plate crown from that of the above-mentioned roll shifting roll 30. The roll 20 has a roll contour which includes the defect compensation contours 34, 37 and 39 that have been described with reference to FIGS. 15A, 15B and 15C.

As illustrated in FIG. 17, the roll 20 has a contour 26 having nine contiguous sections consisting of the single first region 21 located at the center of the roll 20, and the two second regions 22, third regions 23, fourth regions 24 and fifth regions 25, all of which are located at the opposite sides of the first region 21. Hereinbelow will be explained in detail a case in which the upper work roll 31 has the contour 26. The lower work roll has the same contour as the upper work roll, but is rotates 180° with respect to the upper work roll.

The first region 21 located at the center of the roll 20 is formed to have substantially the same length at the opposite sides of a vertical center line X. First region 21 has an external surface which is inclined with respect to an axis of the roll, and has a decreasing or increasing roll diameter from one end (for instance, a left end) of the roll towards the other (for instance, a right end). In the illustrated embodiment, the first region 21 has a contour in which the diameter decreases from left to right or increases from right to left.

The second regions 22 including a left-side second region 22*a* and a right-side second region 22*b* are located contiguous to and at opposite sides of the first region 21. In the left-side second region 22*a*, the roll diameter stops increasing and begins decreasing toward the left end of the roll 20, whereas in the right-side second region 22*b*, the roll diameter stops decreasing and begins increasing toward the right end of the roll 20.

In the third regions 23 located contiguous to each of the second regions 22 and including a left-side region 23*a* and a right-side region 23*b*, the roll diameter decreases or increases, respectively, so that the roll diameter in the third regions 23 varies in a direction opposite to that of the first region 21. In other words, the third regions 23 are inclined in a direction just opposite to the inclination of the first region 21. Specifically, in the left-side region 23*a*, the roll diameter decreases toward the left end of the roll 20, whereas in the right-side region 23*b*, the roll diameter increases toward the right end of the roll 20. In the fourth regions 24 located contiguous to each of the third regions 23 and including a left-side region 24*a* and a right-side region 24*b*, the roll diameter is decreasing or increasing as in the third regions 23, but to a smaller degree or with a smaller gradient then the third regions 23. Specifically, in the left-side region 24*a*, the roll diameter decreases with a smaller gradient or at a smaller rate than that of the left-side third region 23*a* toward the left end of the roll 20, whereas in the right-side region 24*b*, the roll diameter increases with a smaller gradient or rate than right-side third region 24*b* toward the right end of the roll 20.

In the fifth regions 25 located outermost and contiguous to each of the fourth regions 24 and including a left-side region 25*a* and a right-side region 25*b*, the roll diameter is kept substantially the same as the end of fourth regions 24. The fifth regions 25 are therefore substantially cylindrical in shape. As an alternative to the cylindrical shape, as illustrated in FIG. 17 with a broken line, the fifth regions 25 may have a contour in which the change in roll diameter is opposite to regions 24, so that the roll diameter varies in the same direction as that of the first region 21. Specifically, in the left-side region 25*a*, the roll diameter may either be kept constant or increase toward the left end of the roll 20, whereas in the right-side region 25*b*, the roll diameter is either kept constant or decreases toward the right end of the roll 20.

In accordance with the roll contour 26 consisting of the nine regions, namely, the first region 21 to the fifth regions 25, it is possible to enhance the plate crown controllability by means of roll shifting for a plate to be rolled having an intermediate or narrow width. Further, the additional use of roll bending allows the roll deflection to overlap, thereby making is possible to roll a plate with a roll contour in which the work roll surface in contact with the plate to be rolled varies smoothly.

Figure 18A:
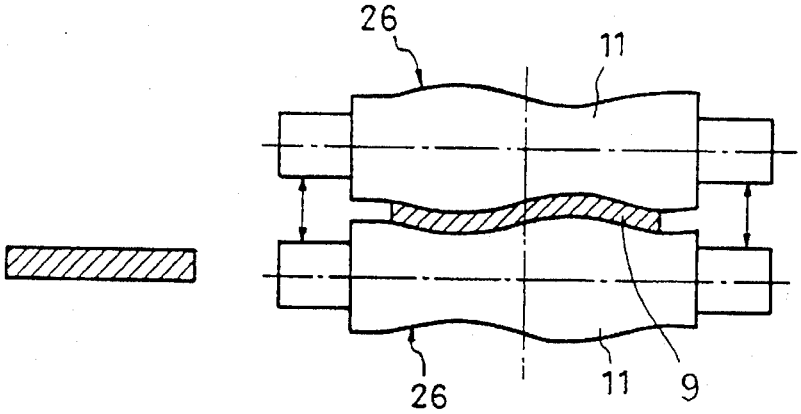
FIGS. 18A, 18B and 18C are schematic views illustrating a contour of a roll in accordance with an embodiment of the invention for varying the plate crown.
Figure 18B:
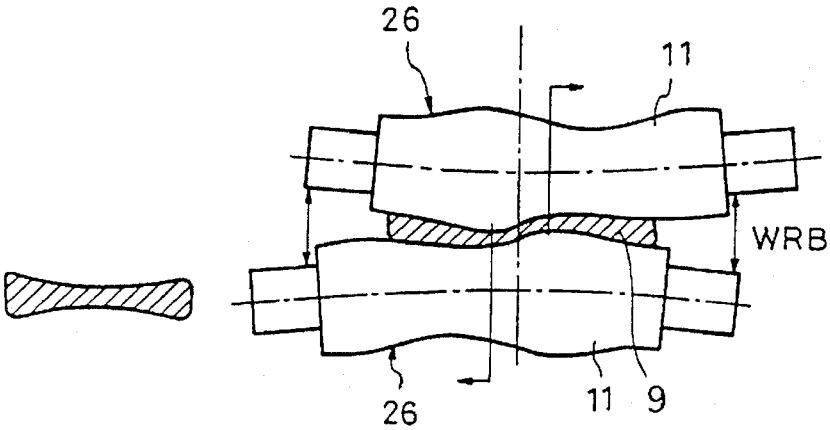
Figure 18C:
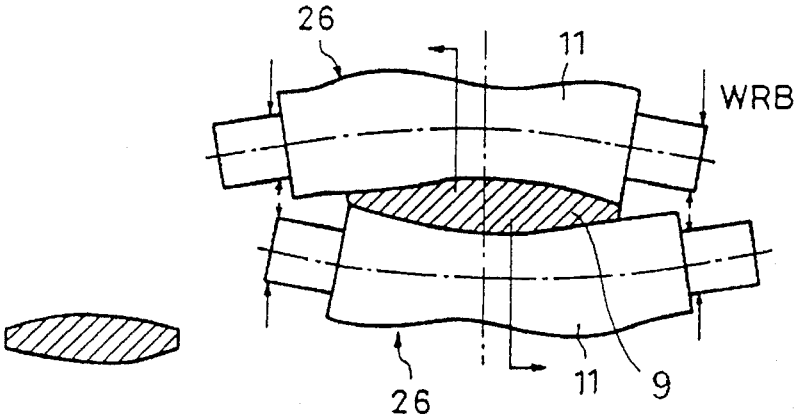

A rolling mill may include the upper and lower work rolls 31 having the contour 26 in which the roll diameter profile is varied in opposite directions i.e., the profiles of the upper and lower rolls 31 are rotated 180° to thereby carry out work roll shifting together with work roll bending (WRB). In accordance with such a rolling mill, it is possible to roll a plate to achieve a flat crown condition as illustrated in FIG. 18A, a concave crown as illustrated in FIG. 18B, or a convex crown as illustrated in FIG. 18C.

However, the use of the work rolls 31 having the above mentioned contour 26 consisting of the nine regions, namely the first region 21 to the fifth regions 25, cannot provide optimal plate crown effect because the work rolls are subject to defects (see FIGS. 15A, 15B and 15C) which would occur in actual rolling. Thus, these defects should be compensated for.

Thus, the contour comprising one or more of the earlier mentioned heat crown compensation contour 34, roll deflection compensation contour 37 and increased surface pressure compensation contour 39 is combined with the contour 26 comprising the nine regions, namely the first region 21 to the fifth regions 25 of the work roll, to thereby form the roll contour 20 to be used for roll shifting.

For instance, when roll shift type rolling is carried out by means of the contour 26 comprising the first region 21 to the fifth regions 25, and at the same time, the heat crown defect is compensated for, the roll contour 26 indicated with a chain line A illustrated in FIG. 16A is combined with the heat crown compensation contour 34 indicated with a solid line B illustrated in FIG. 16B.

The heat crown develops as the greater number of plates are rolled, i.e., as the rolls heat up, and plateaus when the number of plates rolled reaches a certain number. Accordingly, the heat crown compensation contour may itself be a cause of rolling defects.

Thus, until the heat crown itself sufficiently develops, a plate is rolled with the work rolls being shifted so that the heat crown compensation contour is negated, namely toward increasing the thickness of plate edges. Once the heat crown effect has sufficiently developed, the plates are then rolled with the work rolls being shifted in the opposite direction to achieve the heat crown compensation contour. The number of plates rolled after the heat crown effect has developed is usually much greater than the number of plates rolled before the heat crown effect has developed, and thus a majority of plates are rolled with the work rolls being shifted only in a single direction.

Accordingly, only one of the ends of the work roll is additionally provided with a curve 39 illustrated in FIG. 16C for compensating for an increased surface pressure due to roll shifting.

Thus, the roll has a contour 20 indicated by a solid line D in FIG. 16D which is a combination of roll contour 26 (FIG. 16A) for varying the plate crown, heat crown compensation contour 34 (FIG. 16B) and contour 39 (FIG. 16C) for compensating for an increased surface pressure at the work roll ends due to roll shifting.

A pair of the thus formed rolls 20 is disposed so that one is above the other and their ends are located opposite to one another. In other words, the contours of the upper and lower work rolls are located as if they are in point symmetry, and the contours of the upper and lower work rolls are not complementary to each other.

Thus, by combining the roll contour 26 for controlling the plate crown to the roll deflection compensation contour 37 for compensating the roll deflection 35 caused by a nominal rolling force, it is possible to carry out roll shift type rolling with the roll deflection 35 caused by a nominal rolling force, one rolling defect being automatically compensated for.

Accordingly, the combination of the roll contour 26 for controlling the plate crown with one or more of the roll contours 34, 37 and 39 for compensating for rolling defects makes it possible to carry out roll shift type rolling with rolling defects being compensated for corresponding to the contours used alone (34, 37, 39) or in combination (34, 37; 34, 39; 37, 39; 34, 37, 39).

Figure 19:
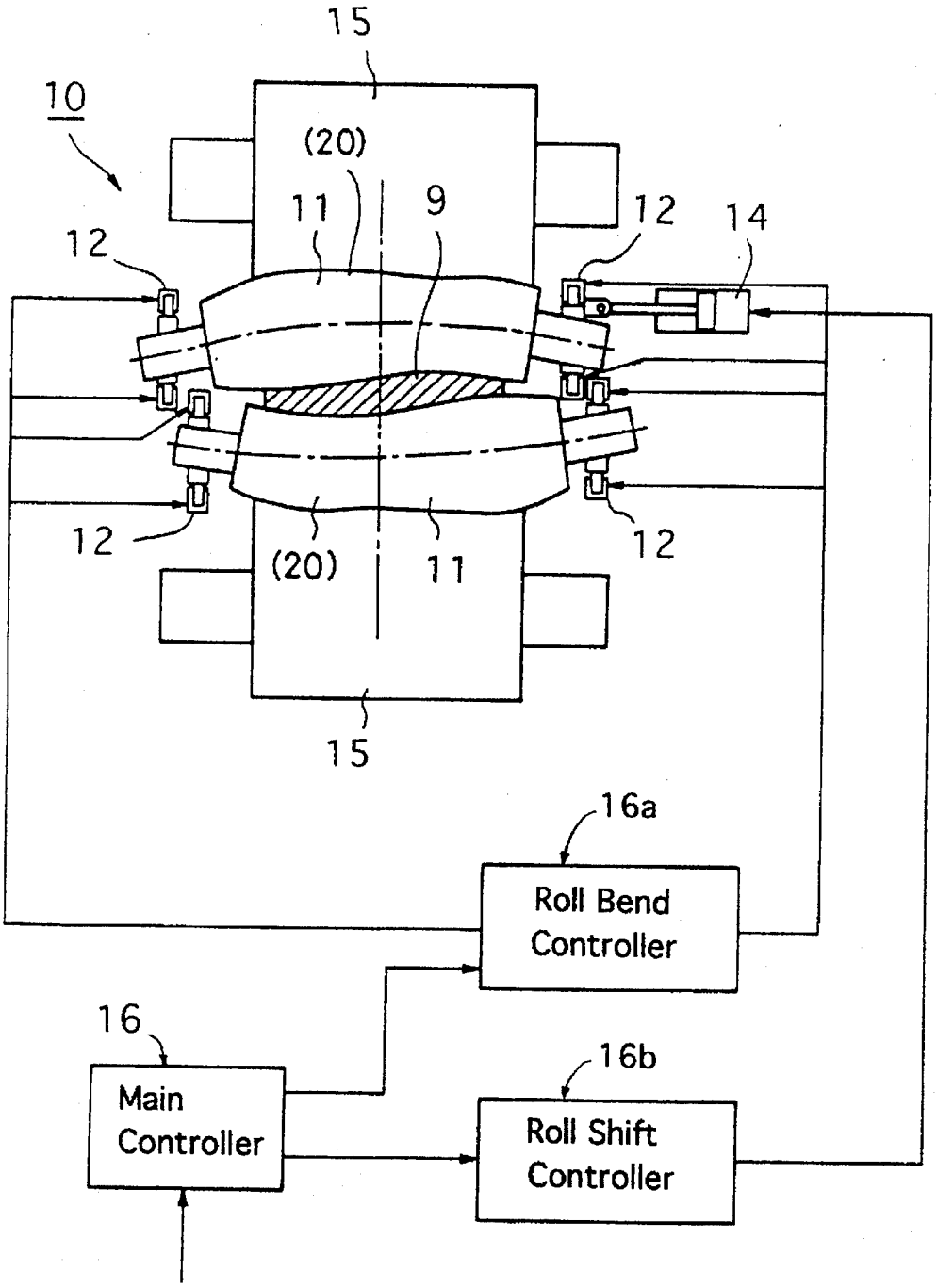
FIG. 19 is a schematic view illustrating a roll shift type rolling mill which uses a roll in accordance with the invention.
Figure 20:
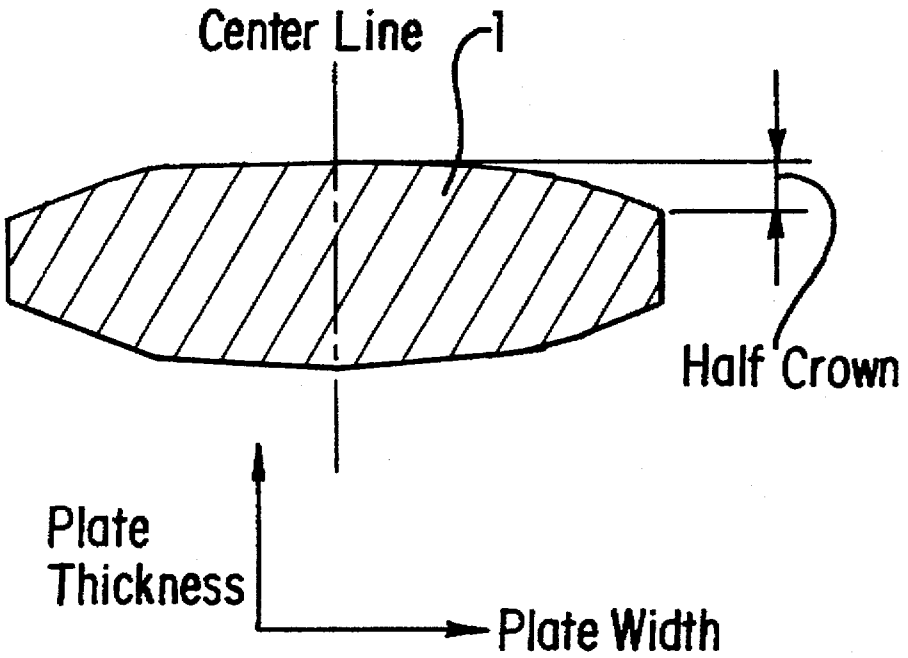
FIG. 20 is a schematic view illustrating the crown of a plate.

Hereinbelow, with reference to FIG. 19, will be explained an embodiment of a roll shifting type rolling mill using the above mentioned rolls.

A roll shifting type rolling mill 10 includes a roll bending device 12 for applying a bending force to the upper and lower work rolls 11, and a roll shifting device 14 for axially shifting the upper and lower work rolls 11 in opposite directions.

Above the work rolls 11 are disposed back-up rolls 15 or intermediate rolls (not illustrated) for supporting the upper and lower work rolls 11.

The rolling mill 10 is further provided with a main controller 16 which determines the amount of roll shift and the roll bending force depending on the width of a plate 9 to be rolled, and emits a signal representing these parameters to the roll bending device 12 and the roll shifting device 14 through a roll bend controller 16*a* and a roll shift controller 16*b* to thereby optimally control the roll shifting and roll bending of the work rolls 11.

Thus, the roll shifting type rolling mill 10 rolls the plate 9 with the plate crown being set to flat crown, concave crown or convex crown as is explained above with reference to FIGS. 18A to 18C. In addition, the roll shift type rolling mill 10 can avoid being influenced by the rolling defects by means of the roll contour of the work rolls 11 to which the compensation contours 34, 37, 39 have been added.

Thus, the roll shifting type rolling can be carried out in response to every rolling condition by the use of the roll 20, as the upper and lower work rolls 11, to which one or more of the rolling defects compensation contours 34, 37, 39 is combined.

As has been described with reference to the preferred embodiments, the roll in accordance with the embodiment to be used for roll shifting operation is designed to be used in a mill which axially shifts the upper and lower work rolls in opposite directions to thereby roll a plate. The upper and lower work rolls are provided with a first contour which is able to vary the plate crown depending on the amount of roll shift, and a second contour for compensating for rolling defects. Thus, the roll having the first and second contours which can vary the plate crown so that rolling defects can be compensated for, enables optimum roll shifting type rolling without being influenced by rolling defects.

In the roll in accordance with the another preferred embodiment, the above mentioned first contour of the upper and lower work rolls for varying the plate crown comprises end portions of the upper and lower work rolls located opposite axial ends of the upper and lower work rolls, which end portions have a roll diameter decreasing towards the respective ends of the upper and lower work rolls. Thus, the roll varies the plate crown so as to compensate for rolling defects, and enables optimum roll shift type rolling by means of the first contour without being influenced by rolling defects.

Each of the upper and lower rolls in accordance with the still another preferred embodiment to be used for roll shift operation has a first contour for varying the plate crown, the contour comprising (a) a first region located at a longitudinal center of the roll, in which a roll diameter of each of the upper and lower work rolls increases or decreases in a direction from one end of each of the upper and lower work rolls to the other, (b) second regions located contiguous to and at opposite sides of the first region, in which the roll diameter of each of the upper and lower work rolls stops increasing or decreasing and begins to decrease or increase, that is, the change in diameter reverses to a direction opposite the first region, (c) third regions located contiguous to each of the second regions, in which a roll diameter of each of the upper and lower work rolls decreases or increases, such that the roll diameter of each of the upper and lower work rolls in the third regions varies in a direction opposite to that of the first region, (d) fourth regions located contiguous to each of the third regions, in which a roll diameter of each of the upper and lower work roll decreases or increases, in the same direction as the third regions, but in a smaller gradient or to a smaller degree than that of the third regions, and (e) fifth regions located continuously adjacent to each of the fourth regions, in which a roll diameter of each of the upper and lower work rolls is either kept to be substantially the same as that of the fourth regions and thereby said fifth regions are substantially cylindrical in shape, or stops decreasing or increasing and begins to increase or decrease, so that the roll diameter of each of the upper and lower work rolls in the fifth regions varies in the same direction as that of the first region. Thus, the roll widely varies the plate crown so as to compensate for rolling defects, and enables optimum roll shift type rolling by means of the above mentioned contour without being influenced by rolling defects.

The roll in accordance with the yet another preferred embodiment to be used for roll shift operation has a second contour for compensating for rolling defects, the contour is designed to be a curvature for compensating for at least one of roll heat crown, roll deflection caused by a rolling force, and increased surface-pressure at an end of the upper and lower work rolls caused by roll shift operation. If these factors causing rolling defects occur alone or in combination with each other, the roll could vary the plate crown so as to compensate for these factors, and enables optimum roll shift type rolling by means of the above mentioned contour without being influenced by these factors.

A roll shift type rolling mill in accordance with the still yet another preferred embodiment includes a roll bending apparatus for applying a bending force to the upper and lower work rolls, and a roll shifting apparatus for axially shifting the upper and lower work rolls in opposite directions. In addition, the upper and lower work rolls are designed to have a first contour for varying the plate crown and a second contour for compensating for rolling defects. If any one of the factors causing rolling defects is present, the roll shift type rolling mill could vary the plate crown in a wide range by means of the first contour so as to compensate for the factors, and enables to carry out optimum roll shift type rolling by means of the second contour without being influenced by the factors.

As described above, the invention provides a roll with a contour which can cope with every rolling condition, and also provides the roll shift type rolling mill which can carry out roll shifting type rolling under every rolling condition.

While the present invention has been described in connection with certain preferred embodiments, it is to be understood that the subject matter encompassed byway of the present invention is not to be limited to those specific embodiments. On the contrary, it is intended for the subject matter of the invention to include all alternatives, modifications and equivalents as can be included within the spirit and scope of the following claims.

What is claimed is:

1. A roll adapted for use as an upper or lower work roll in a rolling mill for rolling a plate using a roll shift operation axially shifting the upper and lower work rolls, said roll having two ends, a length, a longitudinal center substantially dividing the length in half, and a first contour for varying the plate crown of a rolled plate in dependence on an amount of axial shifting, and a second contour superimposed on said first contour for compensating for rolling defects, the first contour comprising:

a first region having two ends, being disposed straddling the longitudinal center, and having a roll diameter increasing in a direction from one end of the first region to the other;

a second region located contiguous to each end of the first region, having a first end proximal to the first region and a second end distal to the first region, and having a roll diameter that changes from the first end in a direction equal to the direction of change of the first region, stops changing at an intermediate point, and reverses direction from the intermediate point until the second end;

a third region contiguous to each second region, having a first end proximal to the second end of the second region and a second end distal to the second region, and having a roll diameter changing from the first end to the second end in a direction opposite to the change in diameter of the first region;

a fourth region contiguous to each third region, having a first end proximal to the second end of the third region and a second end distal to the third region, and having a change in roll diameter from the first end to the second end in the same direction as in the third region but with a smaller gradient; and a fifth region located contiguous to each fourth region, wherein the roll diameter is kept substantially constant to the diameter at the distal end of the fourth region.

2. The roll as recited in claim 1, wherein said second contour is superimposed on said first contour, for compensating for a rolling defect selected from at least one of roll heat crown, roll deflection caused by a rolling force and increased surface pressure caused by roll shifting.

3. The roll as recited in claim 1, adapted to produce a plurality of different crowns in plates having a width substantially less than the length of the roll, and adapted to produce a smooth contour when bent for contact with the plate.

4. A roll adapted for use as an upper or lower work roll in a rolling mill for rolling a plate using a roll shift operation axially shifting the upper and lower work rolls, said roll having first and second ends, a first contour for varying the plate crown of a rolled plate in dependence on an amount of axial shifting, and a second contour superimposed on said first contour for compensating for rolling defects, wherein said first contour comprises portions proximal to the first and second ends, having a roll diameter decreasing toward said ends.

5. The roll as recited in claim 4, wherein said second contour is a curvature for compensating at least one of roll heat crown, roll deflection caused by a rolling force and increased surface pressure caused by roll shifting.

6. A roll adapted for use as an upper or lower work roll in a rolling mill for rolling a plate using a roll shift operation axially shifting the upper and lower work rolls, having two ends, a length, a longitudinal center substantially dividing the length in half, and a first contour for varying the plate crown of a rolled plate in dependence on an amount of axial shifting, and a second contour superimposed on said first contour for compensating for rolling defects, the first contour comprising:

a first region having two ends, being disposed straddling the longitudinal center, and having a roll diameter increasing in a direction from one end of the first region to the other;

a second region located contiguous to each end of the first region, having a first end proximal to the first region and a second end distal to the first region, and having a roll diameter that changes from the first end in a direction equal to the direction of change of the first region, stops changing at an intermediate point, and reverses direction from the intermediate point until the second end;

a third region contiguous to each second region, having a first end proximal to the second end of the second region and a second end distal to the second region, and having a roll diameter changing from the first end to the second end in a direction opposite to the change in diameter of the first region;

a fourth region contiguous to each third region, having a first end proximal to the second end of the third region and a second end distal to the third region, and having a change in roll diameter from the first end to the second end in the same direction as in the third region but with a smaller gradient; and a fifth region located contiguous to each fourth region, having a first end proximal to the second end of the fourth region and a second end distal to the fourth region, and having a change in roll diameter from the first end to the second end in the same direction as the first region.

7. The roll as recited in claim 6, wherein said second contour is superimposed on said first contour, for compensating for a rolling defect selected from at least one of roll heat crown, roll deflection caused by a rolling force and increased surface pressure caused by roll shifting.

8. The roll as recited in claim 6, adapted to produce a plurality of different crowns in plates having a width substantially less than the length of the roll, and adapted to produce a smooth contour when bent for contact with the plate.

9. A method for rolling a plate comprising the step of rolling a plate, carrying out a combination of roll shifting along an axial direction of at least one roll and roll bending while rolling, said method being carried out by a rolling mill comprising:

upper and lower work rolls, each having first and second ends, a first contour for varying the plate crown in dependence on an amount of roll shifting, and a second contour, superimposed on the first contour, for compensating for rolling defects;

a roll bend device connected to the upper and lower work rolls adapted to apply force to and bend the work rolls; and a roll shift device connected to the upper and lower work rolls and adapted to axially shift the work rolls, wherein said first contour comprises portions proximal to the first and second ends, having a roll diameter decreasing toward said ends; where said second crown contour compensates for at least one of roll heat crown, roll deflection caused by a rolling force and increased surface pressure caused by the roll shifting.

10. A method for rolling a plate comprising the step of rolling a plate, carrying out a combination of roll shifting along an axial direction of at least one roll and roll bending while rolling, said method being carried out by a rolling mill, comprising:

(1) an upper work roll having two ends, a length, a longitudinal center substantially dividing the length in half, and a first contour for varying the plate crown in dependence on an amount of roll shifting, and a second contour, superimposed on the first contour, for compensating for rolling defects, the first contour comprising:

(a) a first region having two ends, being disposed straddling the longitudinal center, and having a roll diameter increasing in a direction from one end of the first region to the other;

(b) a second region located contiguous to each end of the first region, having a first end proximal to the first region and a second end distal to the first region, and having a roll diameter that changes from the first end in a direction equal to the direction of change of the first region, stops changing at an intermediate point, and reverses direction from the intermediate point until the second end;

(c) a third region contiguous to each second region, having a first end proximal to the second end of the second region and a second end distal to the second region, and having a roll diameter changing from the first end to the second end in a direction opposite to the change in diameter of the first region;

(d) a fourth region contiguous to each third region, having a first end proximal to the second end of the third region and a second end distal to the third region, and having a change in roll diameter from the first end to the second end in the same direction as in the third region but with a smaller gradient; and (e) a fifth region located contiguous to each fourth region, wherein the roll diameter is kept substantially constant to the diameter at the distal end of the fourth region;

(2) a lower work roll having two ends, a length, a longitudinal center substantially dividing the length in half, and a first contour for varying the plate crown in dependence on an amount of roll shifting, and a second contour, superimposed on the first contour, for compensating for rolling defects, the first contour being substantially equivalent to the first contour of the upper work roll, except rotated by 180°;

(3) a roll bend device mechanically connected to each of the upper and lower work rolls and adapted to apply force to and bend the upper and lower work rolls;

(4) a roll shift device connected to the upper and lower work rolls and adapted to axially shift the upper and lower work rolls; and (5) a back-up roll for supporting each of the upper and lower work rolls.

11. The method as recited in claim 10, wherein said second contour of said upper and lower work rolls is superimposed said first contour for compensating for a rolling defect selected from at least one of roll heat crown, roll deflection caused by a rolling force and increased surface pressure caused by roll shifting.

12. The method as recited in claim 10, wherein the upper and lower work rolls are adapted to produce a plurality of different crowns in plates having a width substantially less than the length of the roll, and adapted to have a smooth contour in contact with the plate when bent.

13. A method for rolling a plate comprising the step of rolling a plate, carrying out a combination of roll shifting along an axial direction of at least one roll and roll bending while rolling, said method being carried out by a rolling mill, comprising:

(1) an upper work roll having two ends, a length, a longitudinal center substantially dividing the length in half, and a first contour for varying the plate crown in dependence on an amount of roll shifting, and a second contour, superimposed on the first contour, for compensating for rolling defects, the contour comprising:

(a) a first region having two ends, being disposed straddling the longitudinal center, and having a roll diameter increasing in a direction from one end of the first region to the other;

(b) a second region located contiguous to each end of the first region, having a first end proximal to the first region and a second end distal to the first region, and having a roll diameter that changes from the first end in a direction equal to the direction of change of the first region, stops changing at an intermediate point, and reverses direction from the intermediate point until the second end;

(c) a third region contiguous to each second region, having a first end proximal to the second end of the second region and a second end distal to the second region, and having a roll diameter changing from the first end to the second end in a direction opposite to the change in diameter of the first region, (d) a fourth region contiguous to each third region, having a first end proximal to the second end of the third region and a second end distal to the third region, and having a change in roll diameter from the first end to the second end in the same direction as in the third region but with a smaller gradient; and (e) a fifth region located contiguous to each fourth region, having a first end proximal to the second end of the fourth region and a second end distal to the fourth region, and having a change in roll diameter for the first end to the second end in the same direction as the first region;

(2) a lower work roll having two ends, a length, a longitudinal center substantially dividing the length in half, and a first contour for varying the plate crown in dependence on an amount of roll shifting, and a second contour, superimposed or the first contour, for compensating for rolling defects, the first contour being substantially equivalent to the first contour of the upper work roll, except rotated by 180°;

(3) a roll bend device mechanically connected to each of the upper and lower work rolls and adapted to apply force to and bend the upper and lower work rolls;

(4) a roll shift device connected to the upper and lower work rolls and adapted to axially shift the upper and lower work rolls; and (5) a back-up roll for supporting each of the upper and lower work rolls.

14. The method as recited in claim 13, wherein said second contour of said upper and lower work rolls is superimposed on said first contour for compensating for a rolling defect selected from at least one of roll heat crown, roll deflection caused by a rolling force and increased surface pressure caused by roll shifting.

15. The method as recited in claim 13, wherein the upper and lower work rolls are adapted to produce a plurality of different crowns in plates having a width substantially less than the length of the roll, and adapted to have a smooth contour in contact with the plate went bent.

16. A rolling mill comprising:

upper and lower work rolls, each having first and second ends, a first contour for varying the plate crown in dependence on an amount of roll shifting, and a second contour, superimposed on the first contour, for compensating for rolling defects;

a roll bend device connected to the upper and lower work rolls adapted to apply force to and bend the work rolls; and a roll shift device connected to the upper and lower work rolls and adapted to axially shift the work rolls, wherein said first contour comprises portions proximal to the first and second ends, having a roll diameter decreasing toward said ends.

17. The rolling mill as recited in claim 16, wherein said second contour compensates for at least one of roll heat crown, roll deflection caused by a rolling force and increased surface pressure caused by the roll shifting.

18. A rolling mill, comprising:

(1) an upper work roll having two ends, a length, a longitudinal center substantially dividing the length in half, and a first contour for varying the plate crown in dependence on an amount of roll shifting, and a second contour, superimposed on the first contour, for compensating for rolling defects, the first contour comprising:

(a) a first region having two ends, being disposed straddling the longitudinal center, and having a roll diameter increasing in a direction from one end of the first region to the other;

(b) a second region located contiguous to each end of the first region, having a first end proximal to the first region and a second end distal to the first region, and having a roll diameter that changes from the first end in a direction equal to the direction of change of the first region, stops changing at an intermediate point, and reverses direction from the intermediate point until the second end;

(c) a third region contiguous to each second region, having a first end proximal to the second end of the second region and a second end distal to the second region, and having a roll diameter changing from the first end to the second end in a direction opposite to the change in diameter of the first region;

(d) a fourth region contiguous to each third region, having a first end proximal to the second end of the third region and a second end distal to the third region, and having a change in roll diameter from the first end to the second end in the same direction as in the third region but with a smaller gradient; and (e) a fifth region located contiguous to each fourth region, wherein the roll diameter is kept substantially constant to the diameter at the distal end of the fourth region;

(2) a lower work roll having two ends, a length, a longitudinal center substantially dividing the length in half, and a first contour for varying the plate crown in dependence on an amount of roll shifting, and a second contour, superimposed on the first contour, for compensating for rolling defects, wherein the first contour is substantially equivalent to the first contour of the upper work roll, except rotated by 180°;

(3) a roll bend device mechanically connected to each of the upper and lower work rolls and adapted to apply force to and bend the upper and lower work rolls;

(4) a roll shift device connected to the upper and lower work rolls and adapted to axially shift the upper and lower work rolls; and (5) a back-up roll for supporting each of the upper and lower work rolls.

19. The rolling mill as recited in claim 18, wherein said second contour of said upper and lower work rolls is superimposed on contour of said contour for compensating for a rolling defect selected from at least one of roll heat crown, roll deflection caused by a rolling force and increased surface pressure caused by roll shifting.

20. The rolling mill as recited in claim 18, wherein the upper and lower rolls are adapted to produce a plurality of different crowns in plates having a width substantially less than the length of the roll, and adapted to have a smooth contour in contact with the plate when bent.

21. A rolling mill, comprising:

(1) an upper work roll having two ends, a length, a longitudinal center substantially dividing the length in half, and a first contour for varying the plate crown in dependence on an amount of roll shifting, and a second contour, superimposed on the first contour, for compensating for rolling defects, the first contour comprising:

(a) a first region having two ends, being disposed straddling the longitudinal center, and having a roll diameter increasing in a direction from one end of the first region to the other;

(b) a second region located contiguous to each end of the first region, having a first end proximal to the first region and a second end distal to the first region, and having a roll diameter that changes from the first end in a direction equal to the direction of change of the first region, stops changing at an intermediate point, and reverses direction from the intermediate point until the second end;

(c) a third region contiguous to each second region, having a first end proximal to the second end of the second region and a second end distal to the second region, and having a roll diameter changing from the first end to the second end in a direction opposite to the change in diameter of the first region;

(d) a fourth region contiguous to each third region, having a first end proximal to the second end of the third region and a second end distal to the third region, and having a change in roll diameter from the first end to the second end in the same direction as in the third region but with a smaller gradient; and (e) a fifth region located contiguous to each fourth region, having a first end proximal to the second end of the fourth region and a second end distal to the fourth region, and having a change in roll diameter from the first end to the second end in the same direction as the first region;

(2) a lower work roll having two ends, a length, a longitudinal center substantially dividing the length in half, and a first contour for varying the plate crown in dependence on an amount of roll shifting, and a second contour, superimposed on the first contour, for compensating for rolling defects, wherein the first contour is substantially equivalent to the first contour of the upper work roll, except rotated by 180°;

(3) a roll bend device mechanically connected to each of the upper and lower work rolls and adapted to apply force to and bend the upper and lower work rolls;

(4) a roll shift device connected to the upper and lower work rolls and adapted to axially shift the upper and lower work rolls; and (5) a back-up roll for supporting each of the upper and lower work rolls.

22. The rolling mill as recited in claim 21, wherein said second contour of said upper and lower work rolls is superimposed on said first contour for compensating for a rolling defect selected from at least one of roll heat crown, roll deflection caused by a rolling force and increased surface pressure caused by roll shifting.

23. The rolling mill as recited in claim 21, wherein the upper and lower rolls are adapted to produce a plurality of different crowns in plates having a width substantially less than the length of a roll, and adapted to have a smooth contour in contact with the plate when bent.

* * * * *